US011345150B2

(12) United States Patent
Takabe

(10) Patent No.: US 11,345,150 B2
(45) Date of Patent: May 31, 2022

(54) ELECTRONIC DEVICE, LIQUID EJECTING HEAD, AND MANUFACTURING METHOD OF LIQUID EJECTING HEAD

(71) Applicant: SEIKO EPSON CORPORATION, Tokyo (JP)

(72) Inventor: Motoki Takabe, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/828,136

(22) Filed: Mar. 24, 2020

(65) Prior Publication Data

US 2020/0307208 A1 Oct. 1, 2020

(30) Foreign Application Priority Data

Mar. 27, 2019 (JP) ..... JP2019-059709

(51) Int. Cl.
*B41J 2/14* (2006.01)
*B41J 2/16* (2006.01)

(52) U.S. Cl.
CPC ..... *B41J 2/14201* (2013.01); *B41J 2/1607* (2013.01); *B41J 2/1626* (2013.01)

(58) Field of Classification Search
CPC .... B41J 2/14201; B41J 2/1607; B41J 2/1626; B41J 2202/11; B41J 2/161; B41J 2/1629; B41J 2/1631; B41J 2/1623; B41J 2002/14491; B41J 2002/14362; B41J 2002/14419; B41J 2/14233
See application file for complete search history.

(56) References Cited

U.S. PATENT DOCUMENTS 10,000,060 B2 * 6/2018 Naganuma ..... B41J 2/14145
2017/0217179 A1 8/2017 Fukuda et al.

FOREIGN PATENT DOCUMENTS

JP 2017-132210 A 8/2017

OTHER PUBLICATIONS

Virginia Semiconductor, "Everything You Need to Know About the Silicon Wafer Manufacturing", retrieved May 11, 2021, Section: Photlithography (Year: 2021).*
De Gruyter—Kenji Unchino, "Piezoelectric Actuator Renaissance", Sep. 2014, pp. 49-50, Section: Macro to nano and Fig. 5 (Year: 2014).*
ip.com search (Year: 2021).*

* cited by examiner

*Primary Examiner* — Lisa Solomon
(74) *Attorney, Agent, or Firm* — Workman Nydegger

(57) ABSTRACT

An electronic device includes a first member configured by single crystal silicon, in which the first member includes a first surface configured by a {110} plane in the single crystal silicon, a second surface of an opposite side from the first surface, a through-hole which spans from the first surface to the second surface, a first recessed portion which is opened in the first surface and includes a wall surface configured by a {111} plane, the wall surface being inclined by an angle greater than 0° and less than 90° with respect to the first surface in the single crystal silicon, and a second recessed portion opened in the second surface, and a level difference surface having a different inclination to that of the {111} plane is provided in the middle of the wall surface of the first recessed portion in a depth direction.

14 Claims, 13 Drawing Sheets

ELECTRONIC DEVICE, LIQUID EJECTING HEAD, AND MANUFACTURING METHOD OF LIQUID EJECTING HEAD

The present application is based on, and claims priority from JP Application Serial Number 2019-059709, filed Mar. 27, 2019, the disclosure of which is hereby incorporated by reference herein in its entirety.

BACKGROUND

1. Technical Field

The present disclosure relates to an electronic device, a liquid ejecting head, and a manufacturing method of the liquid ejecting head.

2. Related Art

In an electronic device such as a liquid ejecting head which ejects a liquid such as an ink from a plurality of nozzles, for example, as disclosed in JP-A-2017-132210, a member formed from a single crystal silicon substrate including through-holes formed by anisotropic etching may be used. In JP-A-2017-132210, a surface is formed by subjecting a silicon single crystal substrate to anisotropic etching to form through-holes which extend in the thickness directions. In the anisotropic etching, a plurality of recessed portions of different depths are formed in the silicon single crystal substrate in addition to the through-holes. Here, the plurality of recessed portions are formed by widening the openings in a mask in a stepwise manner.

In the technique described in JP-A-2017-132210, level differences may be formed in wall surfaces of the through-holes caused by the widening of the openings in the mask during the anisotropic etching as described earlier. The level differences are formed at a minute width part-way down the wall surfaces of the through-holes extending in the thickness directions of the substrate. Therefore, visually recognizing the level differences from the openings of the through-holes is difficult. In the related art, there is a problem in that there is no method of evaluating the state of the level differences without destroying the substrate including the through-holes, and as a result, through-holes having increased dimensional precision may not be efficiently manufactured.

SUMMARY

According to an aspect of the present disclosure, there is provided an electronic device which includes a first member configured by single crystal silicon, in which the first member includes a first surface configured by a {110} plane in the single crystal silicon, a second surface of an opposite side from the first surface, a through-hole which spans from the first surface to the second surface, a first recessed portion which is opened in the first surface and includes a wall surface configured by a {111} plane, the wall surface being inclined by an angle greater than 0° and less than 90° with respect to the first surface in the single crystal silicon, and a second recessed portion opened in the second surface, and a level difference surface having a different inclination to that of the {111} plane is provided in the middle of the wall surface of the first recessed portion in a depth direction.

According to another aspect of the present disclosure, there is provided a liquid ejecting head which includes a first member configured by single crystal silicon, in which the first member includes a first surface configured by a {110} plane in the single crystal silicon, a second surface of an opposite side from the first surface, a through-hole which spans from the first surface to the second surface, a first recessed portion which is opened in the first surface and includes a wall surface configured by a {111} plane, the wall surface being inclined with respect to the first surface in the single crystal silicon, and a second recessed portion opened in the second surface, and a level difference surface of a direction along the first surface is provided in the middle of the wall surface of the first recessed portion in a depth direction.

According to still another embodiment of the present disclosure, there is provided a manufacturing method of a liquid ejecting head, the method including preparing a first member which is a member configured by single crystal silicon and which includes a first surface configured by a {110} plane in the single crystal silicon, and a second surface of an opposite side from the first surface, and forming a through-hole which spans from the first surface to the second surface, a first recessed portion which is opened in the first surface and includes a wall surface configured by a {111} plane, the wall surface being inclined with respect to the first surface in the single crystal silicon, and a second recessed portion opened in the second surface using anisotropic etching, in which a time point to stop the anisotropic etching is determined based on a state of a level difference surface which is formed as a surface in a direction along the first surface in a depth direction in the middle of the wall surface of the first recessed portion.

DESCRIPTION OF EXEMPLARY EMBODIMENTS

1. First Embodiment

1-1. Liquid Ejecting Apparatus

Figure 1:
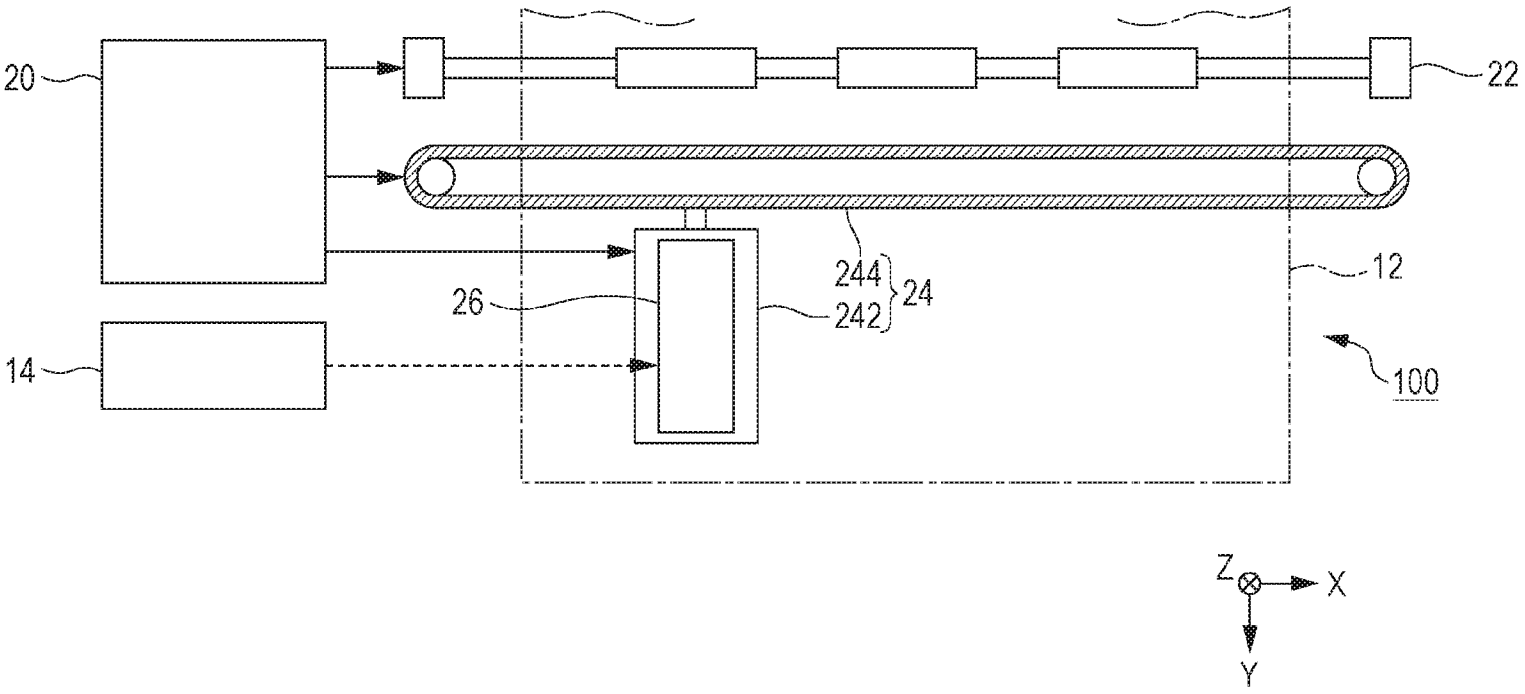
FIG. 1 is a view illustrating a configuration of a liquid ejecting apparatus according to a first embodiment.

FIG. 1 is a view illustrating a configuration of a liquid ejecting apparatus 100 according to the first embodiment. The liquid ejecting apparatus 100 is an ink jet system printing apparatus which ejects an ink, which is an example of a liquid, onto a medium 12. Although the medium 12 is typically printing paper, a printing target of an arbitrary material such as a resin film or a fabric is to be used as the medium 12. As exemplified in FIG. 1, a liquid container 14 which stored the ink is installed in the liquid ejecting apparatus 100. For example, a cartridge which is attachable and detachable with respect to the liquid ejecting apparatus 100, a bag-shaped ink pack formed by a flexible film, or an ink tank refillable with the ink is used as the liquid container 14. Ink of a plurality of types having different colors is stored in the liquid container 14.

As exemplified in FIG. 1, the liquid ejecting apparatus 100 includes a control unit 20, a transport mechanism 22, a movement mechanism 24, and a liquid ejecting head 26 which is an example of an electronic device. The control unit 20 includes a processing circuit such as a central processing unit (CPU) or a field programmable gate array (FPGA) and a memory circuit such as semiconductor memory, for example, and performs overall control of each element of the liquid ejecting apparatus 100. The transport mechanism 22 transports the medium 12 in Y direction under the control of the control unit 20.

The movement mechanism 24 causes the liquid ejecting head 26 to reciprocate along X directions under the control of the control unit 20. The X directions are directions orthogonally intersecting the Y direction in which the medium 12 is to be transported. The movement mechanism 24 of the first embodiment includes a substantially box-shaped transporting body 242 (a carriage) which stores the liquid ejecting head 26 and a transport belt 244 to which the transporting body 242 is fixed. It is possible to adopt a configuration in which a plurality of the liquid ejecting heads 26 is installed on the transporting body 242 or a configuration in which the liquid container 14 is installed on the transporting body 242 together with the liquid ejecting head 26.

The liquid ejecting head 26 ejects the ink supplied from the liquid container 14 onto the medium 12 from a plurality of nozzles under the control of the control unit 20. A desired image is formed on the surface of the medium 12 due to the liquid ejecting head 26 ejecting the ink onto the medium 12 in parallel with the transporting of the medium 12 by the transport mechanism 22 and the repetitive reciprocation of the transporting body 242. A direction perpendicular to an X-Y plane will be denoted as a Z direction hereinafter. The ejection direction of the ink by the liquid ejecting head 26 corresponds to the Z direction. The X-Y plane is a plane parallel to the surface of the medium 12, for example.

1-2. Liquid Ejecting Head

Figure 2:
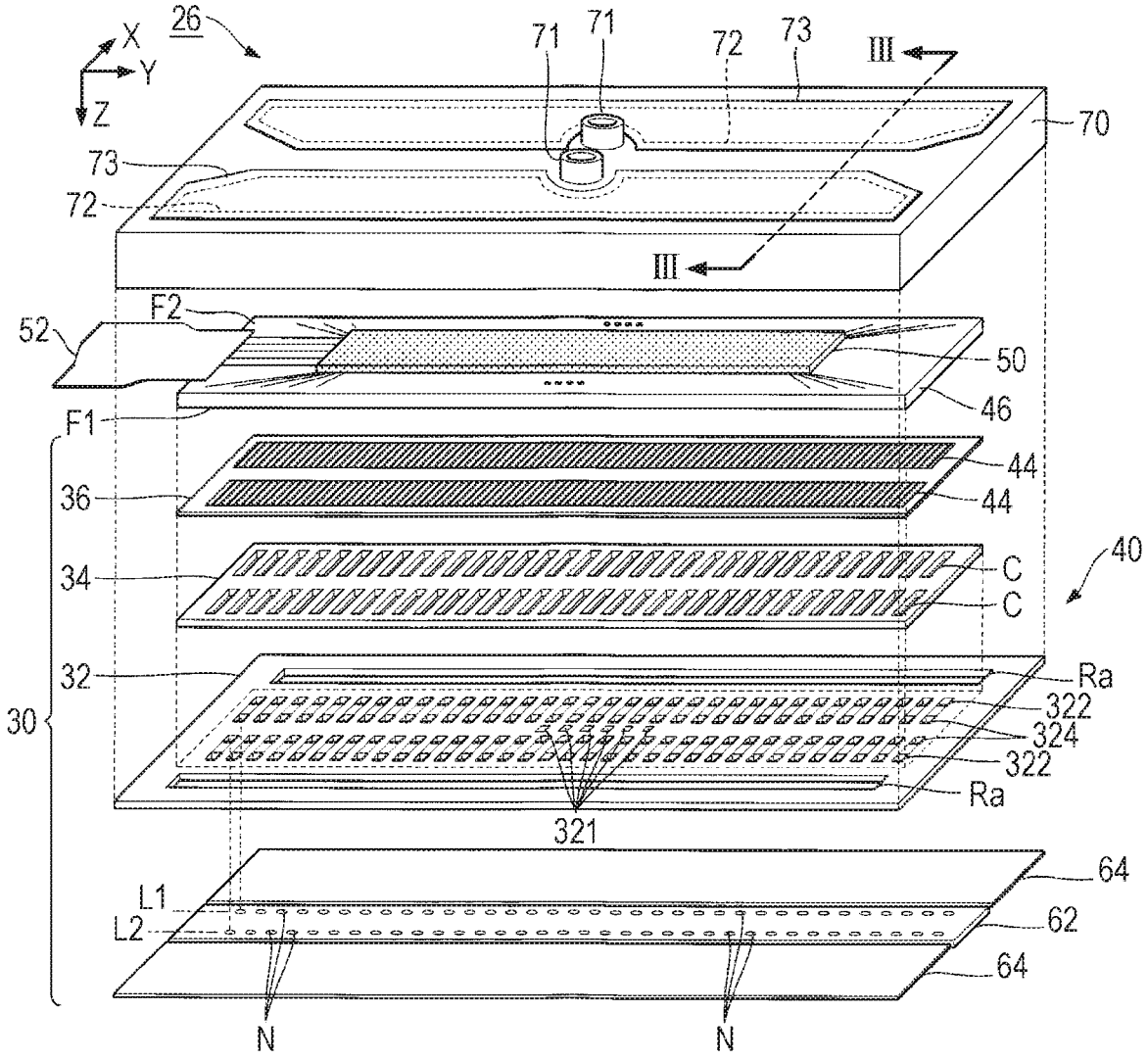
FIG. 2 is an exploded perspective diagram of a liquid ejecting head.
Figure 3:
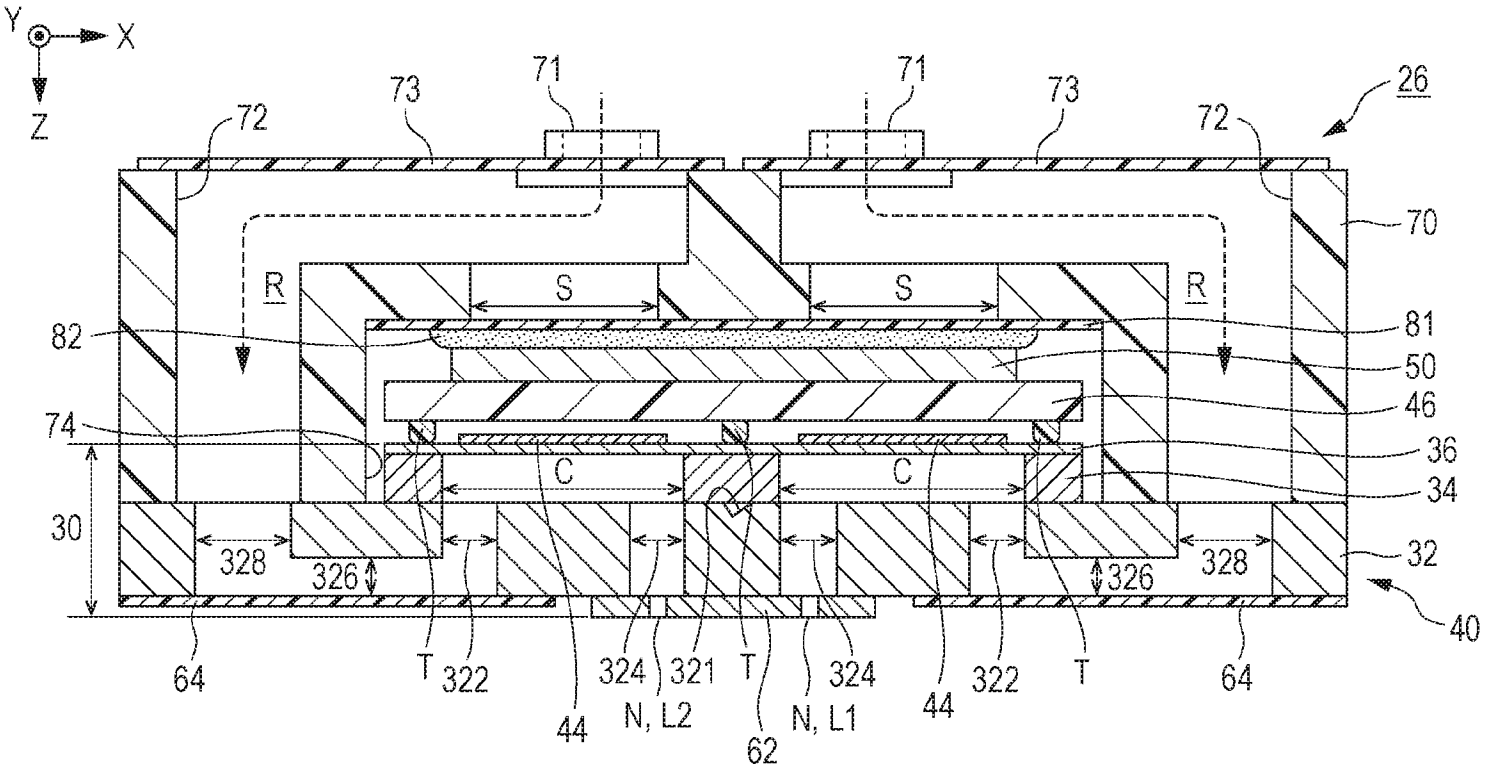
FIG. 3 is a sectional diagram (a sectional diagram taken along a III-III line in FIG. 2) of the liquid ejecting head.

FIG. 2 is an exploded perspective diagram of the liquid ejecting head 26 and FIG. 3 is a sectional diagram taken along the III-III line in FIG. 2. FIGS. 2 and 3 schematically illustrate the shapes of each part of the liquid ejecting head 26. As exemplified in FIG. 2, the liquid ejecting head 26 includes a plurality of nozzles N arranged in the Y direction. The plurality of nozzles N of the first embodiment are divided into a first row R1 and a second row R2 provided parallel to each other leaving an interval therebetween in the X directions. Each of the first row R1 and the second row R2 is a collection of the plurality of nozzles N arranged linearly in the Y direction. Although it is also possible to adopt a staggered arrangement in which the positions of each of the nozzles N are different in the Y direction between the first row R1 and the second row R2, a configuration in which the positions of each of the nozzles N match in the Y direction between the first row R1 and the second row R2 will be exemplified for convenience hereinafter. As can be understood from FIG. 3, the liquid ejecting head 26 of the first embodiment has a structure in which elements relating to each of the nozzles N of the first row R1 and elements relating to each of the nozzles N of the second row R2 are disposed to be substantially symmetrical with respect to a plane.

As exemplified in FIGS. 2 and 3, the liquid ejecting head 26 includes a liquid ejecting section 40 which ejects the ink from the nozzles N, a drive circuit 50 which drives the liquid ejecting section 40 and a housing portion 70 in which a space which stores the ink is formed. The liquid ejecting section 40 is configured to include a flow path structural body 30, piezoelectric elements 44, and a wiring substrate 46. Pressure chambers C communicate with the nozzles N and are formed in the inner portion of the flow path structural body 30, the piezoelectric elements 44 change the pressure of pressure chambers C, and a plurality of wires for electrically connecting the drive circuit 50 and the piezoelectric elements 44 to each other are formed in the wiring substrate 46.

The flow path structural body 30 is a structural body which forms flow paths for supplying the ink to the plurality of nozzles N. The flow path structural body 30 of the first embodiment is configured by a flow path substrate 32 which is an example of the first member, a pressure chamber substrate 34 which is an example of the second member, a diaphragm 36, a nozzle plate 62, and a vibration absorbing body 64. Each of the members which configures the flow path structural body 30 is a plate-shaped member which is long in the Y direction. The pressure chamber substrate 34 and the housing portion 70 are installed on the surface of the flow path substrate 32 on the negative side in the Z direction. Meanwhile, the nozzle plate 62 and the vibration absorbing body 64 are installed on the flow path substrate 32 on the positive side in the Z direction. For example, each member is fixed using an adhesive.

The nozzle plate 62 is a plate-shaped member in which the plurality of nozzles N is formed. Each nozzle N of the plurality of nozzles N is a through-hole which allows the ink to pass therethrough. The plurality of nozzles N which configure the first row R1 and the plurality of nozzles N which configure the second row R2 are formed in the nozzle plate 62 of the first embodiment. For example, the nozzle plate 62 is manufactured by using a semiconductor manufacturing technique such as photo-lithography and etching to process a single crystal substrate of silicon (Si). However, well-known materials and manufacturing methods may be adopted arbitrarily for the manufacturing of the nozzle plate 62.

As exemplified in FIGS. 2 and 3, a plurality of supply flow paths 322, a plurality of communicating flow paths 324, a supply liquid chamber 326 which is an example of a second recessed portion, and an opening portion 328 are formed for each of the first row R1 and the second row R2 in the flow path substrate 32. The opening portion 328 is a through-hole formed in a shape which is long along the Y direction in plan view as viewed from the Z direction. Hereinafter, a plan view as viewed from the Z direction will also be referred to as simply "plan view". The supply flow paths 322 and the communicating flow paths 324 are through-holes formed corresponding to each of the nozzles N. The supply liquid chamber 326 is provided in the surface of the flow path substrate 32 on the positive side in the Z direction, is spaced formed in a shape which is long along the Y direction over the plurality of nozzles N, and causes the opening portion 328 and the plurality of supply flow paths 322 to communicate with each other. Each of the communicating flow paths of the plurality of communicating flow paths 324 overlaps one of the nozzles N corresponding to the communicating flow path 324 in plan view. A plurality of recessed portions 321 which are examples of the first recessed portions is provided on a surface of the flow path substrate 32 on the negative side in the Z direction in a region that is bonded to the pressure chamber substrate 34. The plurality of recessed portions 321 are depressions arranged leaving an interval between each other along the Y direction. The recessed portions 321 function as escape portions to which the adhesive which adheres the flow path substrate 32 and the pressure chamber substrate 34 to each other escapes. The recessed portions 321 are used for determining the etching amount and the like when manufacturing the flow path substrate 32 using anisotropic etching which uses a liquid etchant. Here, the flow path substrate 32 is configured by single crystal silicon. The surface of the flow path substrate 32 on the negative side in the Z direction is a first surface F1 configured by a {110} surface in the single crystal silicon. The surface of the flow path substrate 32 on the positive side in the Z direction is a second surface F2 of the opposite side from the first surface F1. With regard to the recessed portions 321 and the communicating flow paths 324, a detailed description will be given later in "1-3. Firsts Member and Second Member" and "1-4. Manufacturing Method of Liquid Ejecting Head".

As exemplified in FIGS. 2 and 3, the pressure chamber substrate 34 is a plate-shaped member in which the plurality of pressure chambers C is formed for each of the first row R1 and the second row R2. The plurality of pressure chambers C is arranged in the Y direction. Each of the pressure chambers C (the cavities) is formed in for each of the nozzles N and is a space which is long along the X directions in plan view. In the same manner as the nozzle plate 62 described earlier, the flow path substrate 32 and the pressure chamber substrate 34 are manufactured by using a semiconductor manufacturing technique to process a single crystal substrate of silicon, for example. However, well-known materials and manufacturing methods may be adopted arbitrarily for the manufacturing of the flow path substrate 32 and the pressure chamber substrate 34. With regard to the manufacturing method of the flow path substrate 32, a detailed description will be given later in "1-4. Manufacturing Method of Liquid Ejecting Head".

As exemplified in FIG. 2, the diaphragm 36 is installed in the pressure chamber substrate 34 on the surface of the opposite side from the flow path substrate 32. The diaphragm 36 of the first embodiment is a plate-shaped member capable of vibrating elastically. A portion or all of the diaphragm 36 may be formed integrally with the pressure chamber substrate 34 by selectively removing portions of the region corresponding to the pressure chambers C in the plate-shaped member of a predetermined plate thickness in the plate thickness directions.

As exemplified in FIG. 3, the pressure chambers C are spaces positioned between the flow path substrate 32 and the diaphragm 36. The plurality of pressure chambers C is arranged in the Y direction for each of the first row R1 and the second row R2. As exemplified in FIGS. 2 and 3, the pressure chambers C communicate with the communicating flow path 324 and the supply flow paths 322. Therefore, the pressure chambers C communicate with the nozzles N via the communicating flow paths 324 and communicate with the opening portions 328 via the supply flow paths 322 and the supply liquid chambers 326.

As exemplified in FIGS. 2 and 3, the piezoelectric elements 44 are formed on the surface of the flow path structural body 30 on the opposite side from the nozzles N. Specifically, the plurality of piezoelectric elements 44 corresponding to the different nozzles N are formed on the surface of the diaphragm 36 of the flow path structural body 30 on the opposite side from the pressure chambers C for each of the first row R1 and the second row R2. Each of the piezoelectric elements 44 is a passive element which changes the pressure of the pressure chamber C by being deformed by a drive signal supplied from the drive circuit 50.

The wiring substrate 46 is a plate-shaped member facing the surface of the diaphragm 36 on which the plurality of piezoelectric elements 44 is formed, leaving an interval therebetween. In other words, the wiring substrate 46 is disposed on the opposite side from the flow path structural body 30 as viewed from the piezoelectric elements 44. The wiring substrate 46 is bonded to the flow path structural body 30 via the adhesive formed of a resin material. The adhesive used in the bonding between the wiring substrate 46 and the flow path structural body 30 is configured of a photosensitive resin, for example. The wiring which electrically connects the drive circuit 50 and the piezoelectric elements 44 to each other is formed in the wiring substrate 46. The wiring substrate 46 of the first embodiment functions as a reinforcement plate which reinforces the mechanical strength of the liquid ejecting head 26 and as a sealing plate which protects and seals the piezoelectric elements 44. The wiring substrate 46 is manufactured by using a semiconductor manufacturing technique to process a single crystal substrate of silicon, for example.

The surface of the wiring substrate 46 on the positive side in the Z direction faces the surface of the diaphragm 36 on which the plurality of piezoelectric elements 44 is formed, leaving an interval therebetween. The drive circuit 50 and an external wiring substrate 52 are mounted to the surface of the wiring substrate 46 on the negative side in the Z direction. As can be understood from the above explanation, the wiring substrate 46 is installed between the flow path structural body 30 and the drive circuit 50 and the plurality of piezoelectric elements 44 is positioned between the flow path structural body 30 and the wiring substrate 46.

The drive circuit 50 outputs the drive signals for driving each of the piezoelectric elements 44 and the reference voltage. The drive circuit 50 is an integrated circuit (IC) chip which is long along the longitudinal direction of the wiring substrate 46. Each of the piezoelectric elements 44 is electrically connected to the drive circuit 50 via a connection terminal T formed on the surface of the wiring substrate 46 on the positive side in the Z direction. The connection terminal T is a resin core bump which forms a connection electrode on the surface of a protrusion formed by a resin material, for example. The external wiring substrate 52 is wiring for electrically connecting the control unit 20 and the drive circuit 50 to each other and is configured by a flexible connection part such as flexible printed circuits (FPC) or a flexible flat cable (FFC).

The housing portion 70 is a case for storing the ink to be supplied to the plurality of pressure chambers C and is formed by injection molding a resin material, for example. The surface of the housing portion 70 on the positive side in the Z direction is bonded to the flow path substrate 32 by an adhesive, for example. As exemplified in FIG. 3, the housing portion 70 functions as a liquid storage chamber (a reservoir) R which stores the ink to be supplied to the plurality of pressure chambers C. The vibration absorbing body 64 is a flexible film which configures a wall surface of a liquid storage chamber R and absorbs pressure fluctuations of the ink inside the liquid storage chamber R.

An introduction port 71 and an opening portion 72 are formed for each of the first row R1 and the second row R2 in the surface of the housing portion 70 on the opposite side from the liquid ejecting section 40. The introduction ports 71 are tube paths through which the ink supplied from the liquid container 14 flows. The ink is supplied to the liquid storage chambers R via the introduction ports 71. The ink inside the liquid storage chambers R is supplied to the pressure chambers C via the supply liquid chambers 326 and each of the supply flow paths 322. A vibration absorbing body 73 which blocks the opening portion 72 is installed on the surface of the housing portion 70 on the opposite side from the liquid ejecting section 40. In the same manner as the vibration absorbing body 64, the vibration absorbing body 73 is a flexible film which absorbs pressure fluctuations of the ink inside the liquid storage chamber R and configures a wall surface of the liquid storage chamber R.

Spaces (hereinafter referred to as "liquid retention chambers") S which branch from the liquid storage chambers R are formed in the housing portion 70. The liquid retention chambers S are spaces which are open toward the negative side in the Z direction, that is, upward in vertical directions.

A recessed-shape storage portion 74 which stores the wiring substrate 46 and the drive circuit 50 is formed in the housing portion 70. As exemplified in FIG. 3, a wall surface member 81 is installed on the inner wall surface of the storage portion 74 in the housing portion 70. The wall surface member 81 configures the wall surfaces of the liquid retention chambers S by blocking the openings corresponding to the liquid retention chambers S in the housing portion 70. For example, a film-shaped or plate-shaped member formed of a resin material is favorable as the wall surface member 81. The wall surface member 81 may be formed integrally with the housing portion 70.

As exemplified in FIG. 3, the wall surface member 81 faces the surface of the drive circuit 50. A filler 82 is interposed between the wall surface member 81 and the drive circuit 50. The filler 82 is a heat-conductive material which fills the gap between the wall surface member 81 and the drive circuit 50. Specifically, a heat-conducting grease or a heat-conducting adhesive material is used favorably as the filler 82.

1-3. First Member and Second Member

Figure 4:
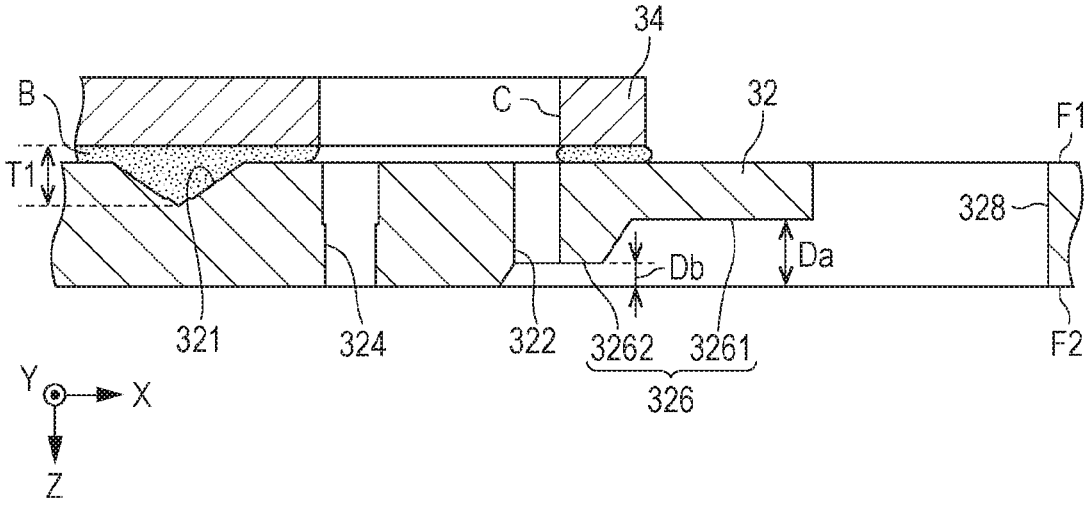
FIG. 4 is a sectional diagram illustrating a flow path substrate which is an example of a first member configured by a silicon single crystal substrate and a pressure chamber substrate which is an example of a second member.

FIG. 4 is a sectional diagram illustrating the flow path substrate 32 which is an example of the first member configured by a silicon single crystal substrate and the pressure chamber substrate 34 which is an example of the second member. As described earlier, the flow path substrate 32 includes the plurality of recessed portions 321, the plurality of supply flow paths 322, the plurality of communicating flow paths 324, the supply liquid chamber 326, and the opening portion 328. Here, the flow path substrate 32 is formed by using a liquid etchant to perform anisotropic etching on a single crystal silicon. Therefore, as illustrated in FIG. 4, each of the wall surfaces of the recessed portion 321, the supply flow path 322, the communicating flow path 324, the supply liquid chamber 326, and the opening portion 328 have shaped aligned with the crystal plane of the single crystal silicon.

Of the recessed portion 321, the supply flow path 322, the communicating flow path 324, the supply liquid chamber 326, and the opening portion 328, each of the elements except for the supply flow path 322 is opened in the first surface F1 of the flow path substrate 32. The pressure chamber substrate 34 is bonded to the first surface F1 via an adhesive B. Here, a portion of the adhesive B enters into the recessed portion 321. The adhesive B is a photosensitive adhesive, for example.

Meanwhile, of the recessed portion 321, the supply flow path 322, the communicating flow path 324, the supply liquid chamber 326, and the opening portion 328, each of the elements except for the recessed portion 321 and the supply flow path 322 is opened in the second surface F2 of the flow path substrate 32. Here, the supply liquid chamber 326 includes a portion 3261 of a depth Da and a portion 3262 of a depth Db which is shallower than the depth Da. The base surfaces of each of the portions 3261 and 3262 are mainly configured by a flat surface parallel to the second surface F2. The supply flow path 322 is opened in the base surface of the portion 3261.

Figure 5:
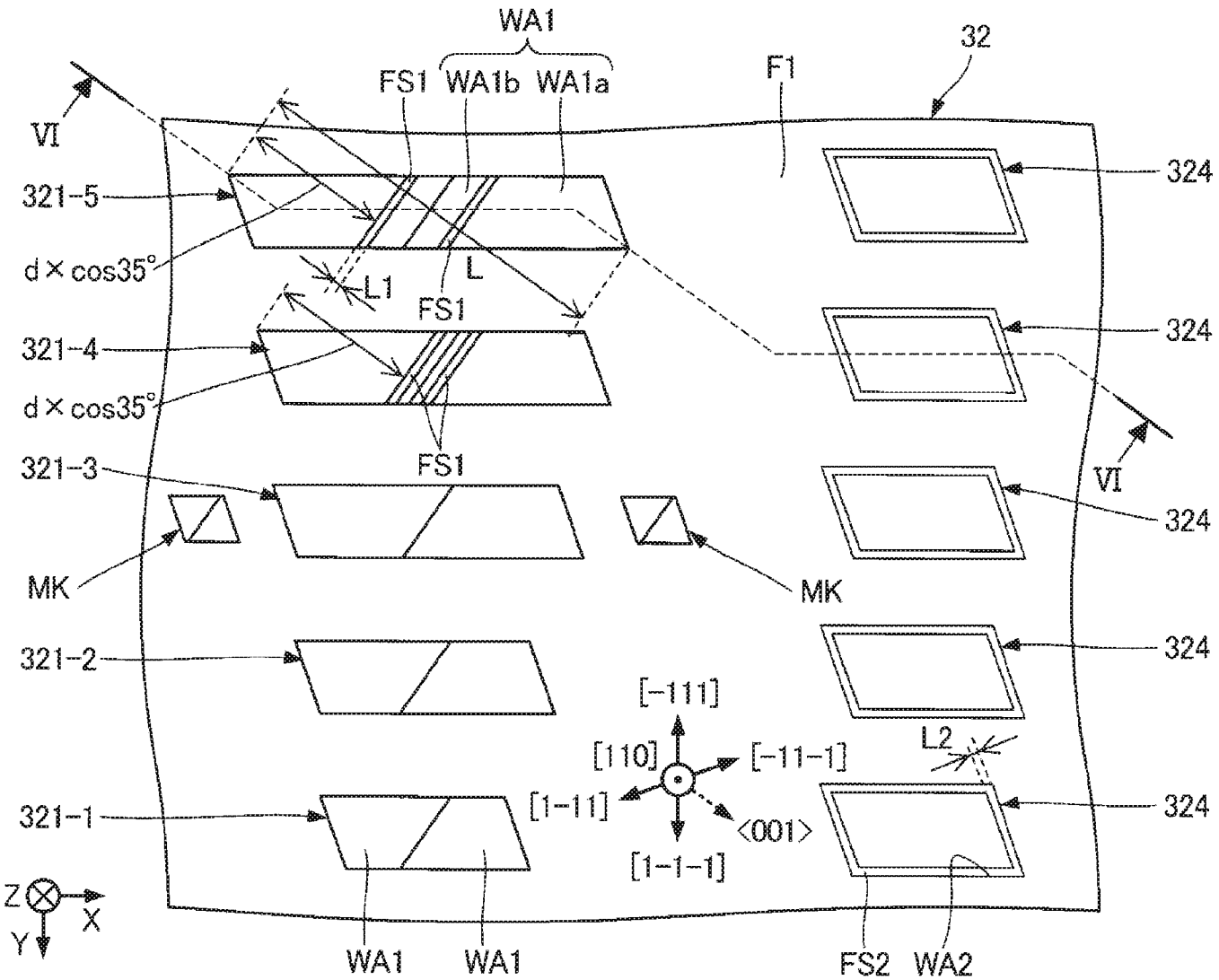
FIG. 5 is a plan view of the flow path substrate as viewed from a first surface side.
Figure 6:
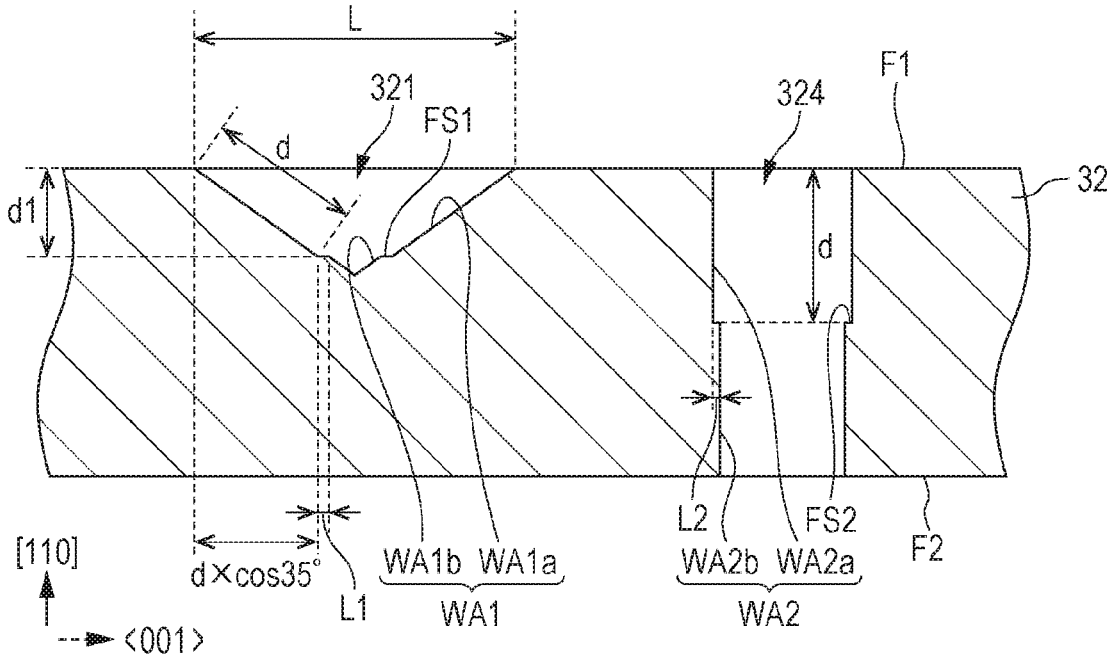
FIG. 6 is a sectional diagram taken along a VI-VI line in FIG. 5.

FIG. 5 is a plan view of the flow path substrate 32 as viewed from the first surface F1 side. FIG. 6 is a sectional diagram taken along a VI-VI line in FIG. 5. The crystal orientation of the single crystal silicon is depicted, as appropriate, in each of FIGS. 5 and 6. Here, the crystal orientation of the single crystal silicon will be depicted using a Miller index. In the present embodiment, the negative side in the Z direction is the [110] direction of the single crystal silicon, the positive side in the X direction is the [−11−2] direction of the single crystal silicon, and the positive side in the Y direction is the [1−1−1] direction of the single crystal silicon. Note that [−111], [−11−1], [1−1−1], and [1−11] are equivalent directions to [111] in the single crystal silicon, and hereinafter, directions equivalent to [111] will be collectively depicted as <111>. Similarly, (−111), (−11−1), (1−1−1), and (1−11) are equivalent planes to (111) in the single crystal silicon, and hereinafter, planes equivalent to (111) will be collectively depicted as {111}. Other crystal orientations and crystal planes of the single crystal silicon will be depicted using Miller indices.

As illustrated in FIGS. 5 and 6, each of the plurality of communicating flow paths 324 includes a wall surface WA2 configured by a {111} plane perpendicular to the first surface F1 in the single crystal silicon. The wall surface WA2 includes a portion WA2*a* which is opened in the first surface F1 and a portion WA2*b* which is opened in the second surface F2 and the portions WA2*a* and WA2*b* are connected to each other via a level difference surface FS2 of a direction along the first surface F1. Here, the length of the portion WA2*a* along the X directions or the Y direction is greater than the length of the portion WA2*b* along the same direction. The level difference surface FS2 is formed by the difference between these lengths. The level difference surface FS2 is provided in an annular shape along the entire periphery of the communicating flow path 324. As described above, the level difference surface FS2 is provided in the middle of the wall surface WA2 in the depth direction of the communicating flow path 324. The level difference surfaces FS2 are formed caused by the openings in a mask increasing in size in the middle of the anisotropic etching (described later). A length L2 of the level difference surface FS2 in the width directions is a length corresponding to the width of the change in the openings in the mask. Although the length L2 is not particularly limited, the length L2 falls within a range of 10 nm to 1 μm, for example. The position of the level difference surface FS2 in the depth direction of the communicating flow path 324 is a position corresponding to the length of time of the anisotropic etching which uses the liquid etchant. The level difference surface FS2 influences the behavior of the liquid which flows through the communicating flow path 324. Therefore, the position of the level difference surfaces FS2 in the depth direction of the communicating flow paths 324 preferably reduces the variation per nozzle N or per liquid ejecting head 26. The level difference surface FS2 may be omitted. In other words, the length of the portion WA2*a* along the X directions or the Y direction may be equal to the length of the portion WA2*b* along the same direction.

In FIG. 5, branch numbers are appended to the plurality of recessed portions 321 to distinguish the recessed portions 321 represented as recessed portions 321-1 to 321-5. As illustrated in FIG. 5, the recessed portions 321-1 to 321-5 have different lengths L from each other along the <001> direction in the single crystal silicon in plan view. Specifically, the lengths L of the recessed portions 321-1 to 321-5 get longer in this order. The recessed portions 321-1 to 321-5 are disposed lined up in the Y direction in order of the length L. In the present embodiment, a pair of marks MK lined up in the X directions is disposed to interpose the one recessed portion 321-3 of the recessed portions 321-1 to 321-5. The pair of marks MK is a pair of recessed portions indicating the one recessed portion 321-3 of the recessed portions 321-1 to 321-5. The marks MK are used together with the recessed portions 321-1 to 321-5 for determining the etching amount and the like during the manufacturing of the flow path substrate 32 using the anisotropic etching.

Each of the recessed portions 321-1 to 321-5 includes wall surfaces WA1 configured by the {111} plane, the wall surface being inclined with respect to the first surface F1 in the single crystal silicon. As illustrated in FIG. 6, the recessed portions 321-1 to 321-5, the wall surfaces WA1 of the recessed portions 321-4 and 321-5 include portions WA1*a* opened in the first surface F1 and portions WA1*b* positioned closer to the second surface F2 side than the portions WA1*a*. The portions WA1*a* and WA1*b* are connected to each other via a level difference surface FS1 of a direction along the first surface F1. As described above, the level difference surface FS1 is provided in the middle of the wall surface WA1 in the depth direction of the recessed portion 321. The level difference surfaces FS1 are formed caused by the openings in the mask increasing in size in the middle of the anisotropic etching (described later). A length L1 of the level difference surface FS1 is a length corresponding to the width of the change in the openings in the mask. Although the length L1 is not particularly limited, the length L1 falls within a range of 10 nm to 1 μm, for example. The position of the level difference surface FS1 in the depth direction of the recessed portion 321 is a position corresponding to the length of time of the anisotropic etching. FIG. 5 illustrates a state in which the level difference surfaces FS1 are lost in the recessed portions 321-1 to 321-3 due to the anisotropic etching.

As described earlier, the lengths L of the recessed portions 321-1 to 321-5 are different from each other. Accordingly, the depths of the recessed portions 321-1 to 321-5 are also different from each other. However, with regard to a distance d between the first surface F1 and the level difference surface FS1 in a direction along the wall surface WA1, the distance d in the recessed portion 321-4 and the distance d in the recessed portion 321-5 are approximately equal. The distance d is approximately equal to the distance from the first surface F1 to the level difference surface FS2 in the communicating flow path 324 described earlier. Therefore, it is possible to determine the etching amount in the communicating flow path 324 based on the distances d in the recessed portions 321 during the manufacturing of the flow path substrate 32 by the anisotropic etching.

As described earlier, the liquid ejecting head 26 includes the flow path substrate 32 which is the first member configured by single crystal silicon. The flow path substrate 32 includes the first surface F1 configured by the {110} face in the single crystal silicon, the second surface F2 on the opposite side from the first surface F1, the communicating flow paths 324 which are through-holes spanning from the first surface F1 to the second surface F2, the recessed portions 321 which are the first recessed portions opened in the first surface F1, and the supply liquid chambers 326 which are the second recessed portions opened in the second surface F2. The recessed portion 321 includes the wall surfaces WA1 configured by the {111} plane, the wall surface being inclined with respect to the first surface F1 in the single crystal silicon by greater than 0° and lesser than 90°. The level difference surface FS1 of a direction along the first surface F1 is provided in the middle of the wall surface WA1 in the depth direction of the recessed portion 321. Here, the level difference surface FS1 has a different inclination to that of the {111} plane which configures the wall surfaces WA1.

In the liquid ejecting head 26, as will described later, it is possible to determine the etching amount in the communicating flow paths 324 based on the state of the level difference surfaces FS1 of the recessed portions 321 during the formation of the communicating flow paths 324 using the anisotropic etching. Therefore, it is possible to efficiently manufacture the flow path substrate 32 having communicating flow paths 324 of high dimensional precision. Here, even if the level difference surface FS2 is formed on the wall surface WA2 of the communicating flow path 324 in accordance with the formation of the supply liquid chamber 326 having a plurality of base surfaces with different depths as described earlier, it is possible to manage the position of the level difference surface FS2 in the depth direction of the communicating flow path 324 with high precision.

The communicating flow path 324 includes the wall surface WA2 configured by the {111} plane perpendicular to the first surface F1 in the single crystal silicon. With regard to the length along a direction perpendicular to the penetrating direction of the communicating flow path 324, the length of the communicating flow path 324 in the first surface F1 is greater than the length of the communicating flow path 324 in the second surface F2. In other words, the width of the communicating flow path 324 in the first surface F1 is greater than the width of the communicating flow path 324 in the second surface F2. Therefore, the level difference surface FS2 is provided in the wall surface WA2. Since the wall surface WA2 is perpendicular to the first surface F1 as described earlier, it is difficult to visually recognize the level difference surface FS2 from outside without destroying the flow path substrate 32. When forming the communicating flow paths 324 using the anisotropic etching (described later), if the state of the level difference surfaces FS1 of the recessed portions 321 is observed, it is possible to indirectly ascertain the state of the level difference surfaces FS2. Therefore, as compared to a case in which the level difference surfaces FS1 are not used, it is possible to form the communicating flow paths 324 including the level difference surfaces FS2 with high precision.

The plurality of level difference surfaces FS1 extending in one direction parallel to each other is provided in the recessed portion 321 of the present embodiment. Therefore, as compared to a case in which the number of the level difference surfaces FS1 provided in the recessed portions 321 is one, it is easy to visually recognize the positions of the level difference surfaces FS1.

The liquid ejecting head 26 includes the pressure chamber substrate 34 which is the second member which is bonded to the first surface F1 by the adhesive B. Here, it is possible to cause a portion of the adhesive B to flow into the recessed portions 321 by provided the recessed portions 321 in a region in the first surface F1 that adheres to the pressure chamber substrate 34. As a result, as compared to a case in which the recessed portions 321 are not provided, there is a merit in that the adhesive B bulging out from between the flow path substrate 32 and the pressure chamber substrate 34 is reduced. In particular, since the adhesive B is pulled in by the capillary phenomenon at a minute angle formed by the recessed portions 321, the merit is notably exhibited. Due to a portion of the adhesive B being disposed in the recessed portions 321, it is possible to increase the adhesion strength between the flow path substrate 32 and the pressure chamber substrate 34 by the adhesive B due to an anchoring effect as compared to a case in which the recessed portions 321 are not provided. In particular, since unevenness is provided by the level difference surfaces FS1 on the wall surfaces WA1 of the recessed portions 321, the anchoring effect is favorably exhibited. Since the recessed portions 321 are provided effectively using the region of the first surface F1 which adheres to the pressure chamber substrate 34, there are merits in that it is not necessary to separately provide the region for the recessed portions 321 in the flow path substrate 32 and the design of the flow path substrate 32 need not be greatly modified from a case in which the recessed portions 321 are not included.

Here, a thickness T1 which is the maximum thickness of the adhesive B is greater than a distance dl between the first surface F1 and the level difference surface FS1 parallel to the thickness directions of the recessed portion 321. Therefore, it is possible to cause the adhesive B to contact the level difference surface FS1 and the anchoring effect and the like are favorably exhibited.

Since there is a plurality of the recessed portions 321, as compared to a case in which the number of the recessed portions 321 is one, it is possible to increase the effects such as the anchoring effect of a case in which the adhesive B is used.

The lengths L of the plurality of recessed portions 321 along the <001> direction in the single crystal silicon in plan view are different from each other. Therefore, it is possible to determine the etching amount in a stepwise manner.

The plurality of recessed portions 321 is disposed to line up in order of the lengths L of the recessed portions 321 along the <001> direction in the single crystal silicon in plan view. Therefore, as compared to a case in which the disposition of the plurality of recessed portions 321 is another disposition such as random, the stepwise determination of the etching amount becomes easy.

The flow path substrate 32 includes one or more marks MK provided on the first surface F1. The one or more marks MK indicate one of the plurality of recessed portions 321. Therefore, it is possible to specify the recessed portion 321 that serves as the standard of the determination of the etching amount by visually recognizing the marks MK. As a result, the determination of the etching amount is easy as compared to a case in which the marks MK are not used.

It is favorable for a ratio L1/L of the length L1 of the level difference surface FS1 along the <001> direction in the single crystal silicon in plan view to the length L of the recessed portion 321 along the <001> direction in the single crystal silicon in plan view to be less than or equal to 1/10, is it more favorable for the ratio to be 1/50 to 1/10, and it is still more favorable for the ratio to be 1/20 to 1/10. In this case, it is possible to prevent the area of the region necessary for the disposition of the recessed portions 321 in the first surface F1 from becoming excessively large while securing the width of the etching amount and the visual recognition properties of the level difference surfaces FS1 necessary for the determination. In contrast, when the ratio L1/L is too small, there is a tendency for visually recognizing the level difference surfaces FS1 by naked eye to become difficult and for the area of the region necessary for the disposition of the recessed portions 321 in the first surface F1 to become excessively large. Meanwhile, when the ratio L1/L is too large, there are cases in which the area of the region necessary for the disposition of the recessed portions 321 in the first surface F1 become excessively large and in which the width of the etching amount possible to determine becomes excessively small.

1-4. Manufacturing Method of Liquid Ejecting Head

Figure 7:
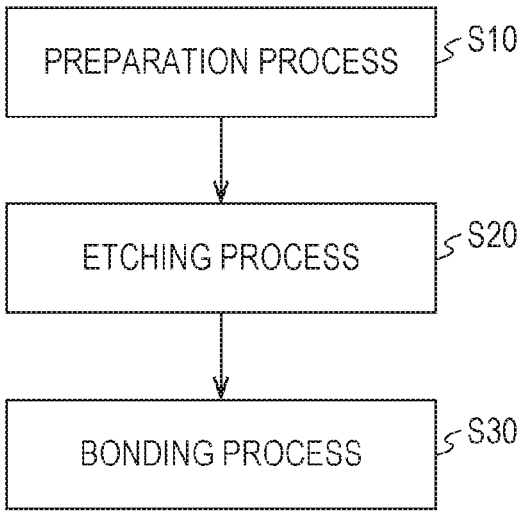
FIG. 7 is a diagram illustrating the flow of a manufacturing method of the liquid ejecting head.

FIG. 7 is a diagram illustrating the flow of a manufacturing method of the liquid ejecting head 26. As illustrated in FIG. 7, the manufacturing method of the liquid ejecting head 26 includes a preparation process S10, an etching process S20, and a bonding process S30. Hereinafter, a description will be given of the processes in order.

1-4a. Preparation Process S10

Figure 8:
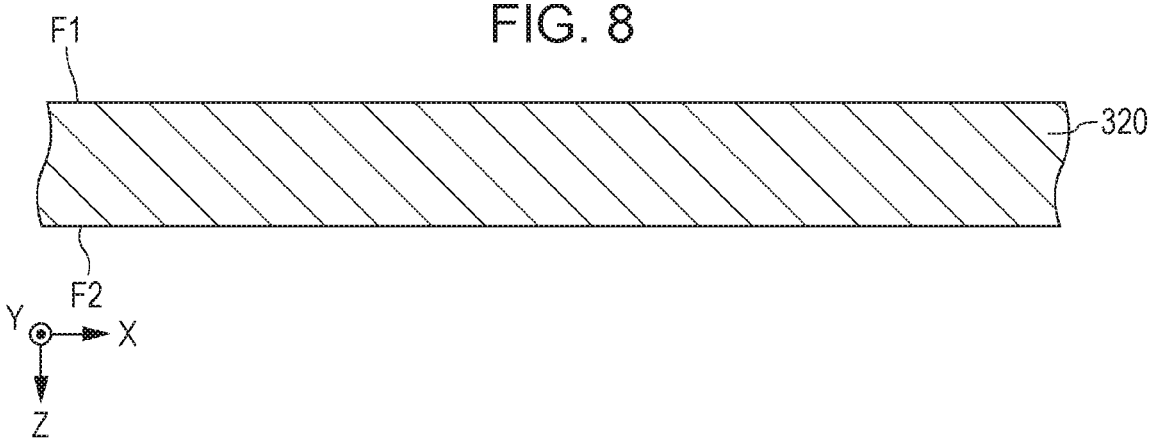
FIG. 8 is a sectional diagram of a silicon single crystal substrate prepared in a preparation process.

FIG. 8 is a sectional diagram of a silicon single crystal substrate prepared in a preparation process S10. In the preparation process S10, first, a substrate 320 which serves as the flow path substrate 32 is prepared. The substrate 320 is a silicon single crystal substrate including the first surface F1 and the second surface F2 which are configured by the {110} plane.

1-4b. Etching Process S20

In the etching process S20, the flow path substrate 32 is formed by processing the substrate 320 using anisotropic etching. Here, the flow path substrate 32 is formed by dividing the anisotropic etching into three times and causing the shape of the openings in the mask used in each time. Hereinafter, a description will be given of the anisotropic etching of each time in order.

Figure 9:
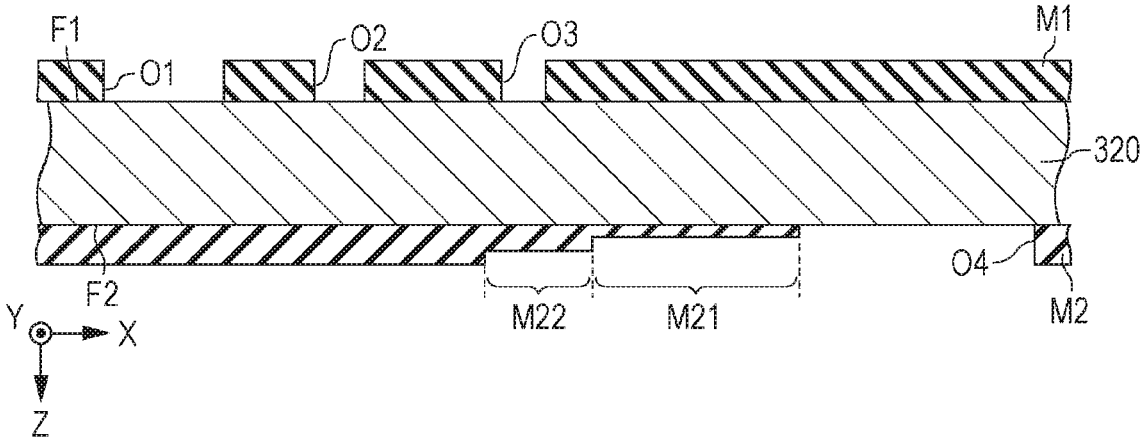
FIG. 9 is a sectional diagram for explaining a mask to be used in a first anisotropic etching in an etching process.

FIG. 9 is a sectional diagram for explaining masks M1 and M2 to be used in the first anisotropic etching in the etching process S20. As illustrated in FIG. 9, the masks M1 and M2 are formed on the substrate 320. The mask M1 is formed on the first surface F1 of the substrate 320. An opening portion O1 of a plan view shape corresponding to that of the recessed portion 321, an opening portion O2 of a plan view shape corresponding to that of the supply flow path 322, and an opening portion O3 of a plan view shape corresponding to that of the communicating flow path 324 are formed in the mask M1. Meanwhile the mask M2 is formed on the second surface F2 of the substrate 320. An opening portion O4 of a plan view shape corresponding to the opening portion 328 is formed in the mask M2. The mask M2 includes a portion M21 corresponding to the portion 3261 of the supply liquid chamber 326 and a portion M22 corresponding to the portion 3262 of the supply liquid chamber 326. Here, the thickness of the portions M21 and M22 is thinner than the other portions of the mask M2. The thickness of the portion M21 is thinner than the portion M22. The masks M1 and M2 are each configured of a silicon oxide film, for example. Although the formation method of the masks M1 and M2 is not particularly limited, it is possible to use a thermal oxidation method or the like, for example. Although not illustrated, opening portions for forming the marks MK are also formed in the mask M1.

Figure 10:
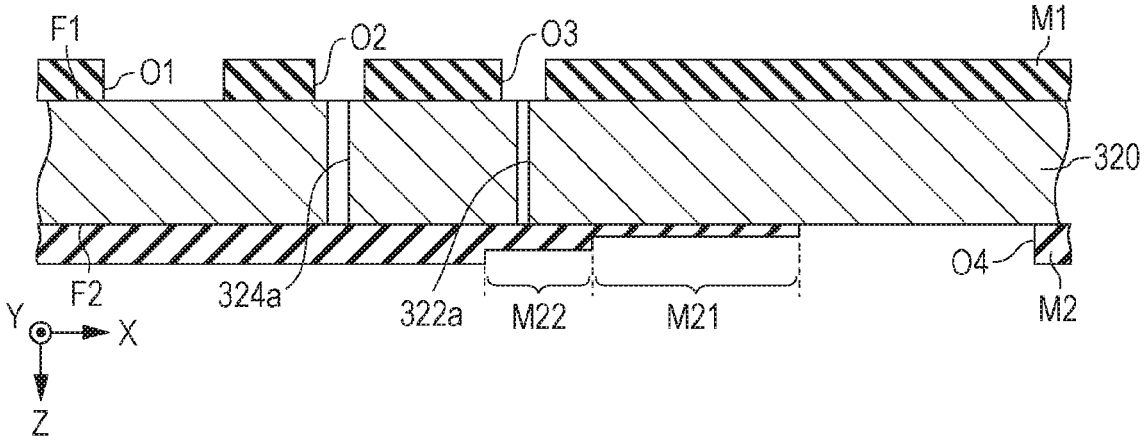
FIG. 10 is a sectional diagram for explaining pilot holes formed before the anisotropic etching in the etching process.

FIG. 10 is a sectional diagram for explaining pilot holes 322*a* and 324*a* formed before the anisotropic etching in the etching process S20. As illustrated in FIG. 10, the pilot hole 322*a* for the supply flow path 322 and the pilot hole 324*a* for the communicating flow path 324 are formed in the substrate 320 before the anisotropic etching. By forming the pilot holes 322*a* and 324*a* in advance, it is possible to form the supply flow path 322 and the communicating flow path 324 having a high aspect ratio using the subsequent anisotropic etching. Although not particularly limited, it is possible to use laser processing, dry etching such as reactive ionic etching of the Bosch process or the like, sand blasting, or the like, for example as the formation method of the pilot holes 322*a* and 324*a*. Although not limited to before the first anisotropic etching, the time point at which the pilot holes 322*a* and 324*a* are to be formed may be between the first anisotropic etching and the second anisotropic etching. However, it is preferable for the time point at which the pilot holes 322*a* and 324*a* are to be formed to be before the anisotropic etching which uses a liquid etchant.

Figure 11:
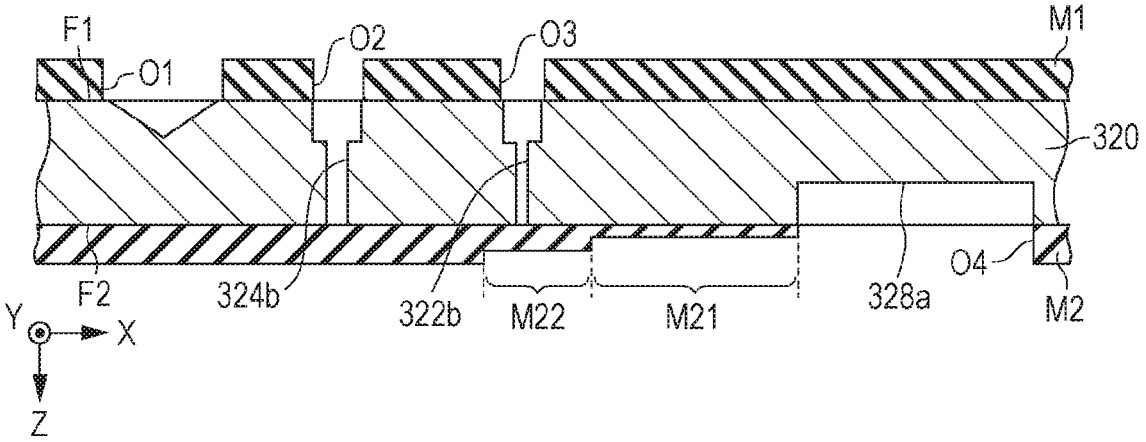
FIG. 11 is a diagram for explaining the first anisotropic etching in the etching process.

FIG. 11 is a diagram for explaining the first anisotropic etching in the etching process S20. As illustrated in FIG. 11, the substrate 320 is subjected to anisotropic etching using the masks M1 and M2. A recessed portion 321*a*, holes 322*b* and 324*b*, and a recessed portion 328*a* are formed by the anisotropic etching. The recessed portion 321*a* is a portion of the recessed portion 321. The hole 322*b* is a hole including a portion of the supply flow path 322 in the depth direction. The hole 324*b* is a hole including a portion of the communicating flow path 324 in the depth direction. The recessed portion 328*a* is a portion of the opening portion 328. For example, a potassium hydroxide aqueous solution (KOH) or the like is used as the etchant of the anisotropic etching. In the anisotropic etching, the etching rate of the {111} plane of the substrate 320 is extremely small as compared to the etching rate of the other crystal planes. Although not illustrated, the marks MK are also formed on a substrate 420 by the anisotropic etching. When using a single crystal silicon substrate having a {110} plane on the first surface F1 and performing anisotropic etching after forming small through-holes, since the etching progresses from a direction such as the first surface F1 direction which is not the {111} plane having a slow etching speed, there is a merit in that it is possible to form thick through-holes having walls perpendicular to the first surface F1 in a short time. Therefore, it is possible to suppress undercutting by an amount corresponding to the shortening of the etching time as compared to a case in which the etching progresses from only one surface.

Figure 12:
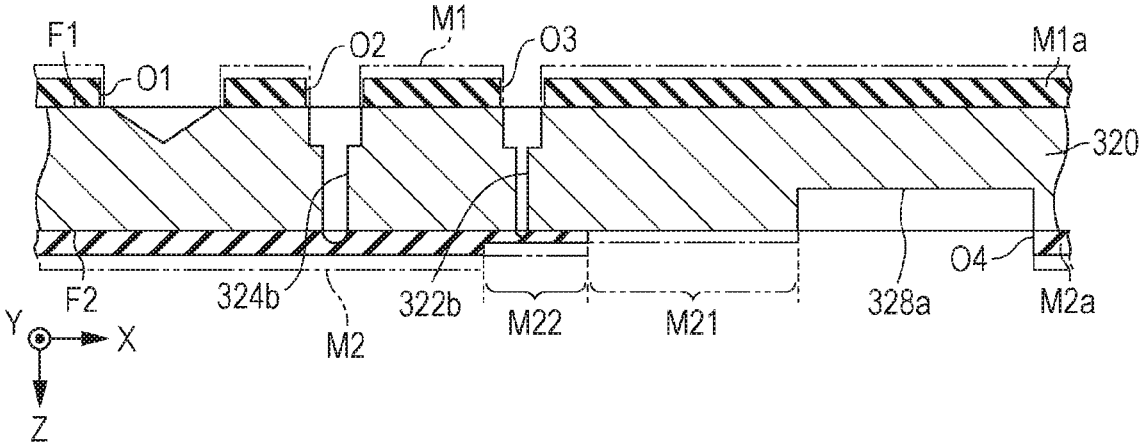
FIG. 12 is a sectional diagram for explaining masks to be used in a second anisotropic etching in the etching process.

FIG. 12 is a sectional diagram for explaining masks M1*a* and M2*a* to be used in the second anisotropic etching in the etching process S20. As illustrated in FIG. 12, the masks M1*a* and M2*a* are obtained by half-etching the masks M1 and M2 in the thickness directions. The mask M2*a* is a mask obtained by removing the portion M21 from the mask M2. For example, hydrofluoric acid (HF) or the like is used as the etchant of the half etching.

Figure 13:
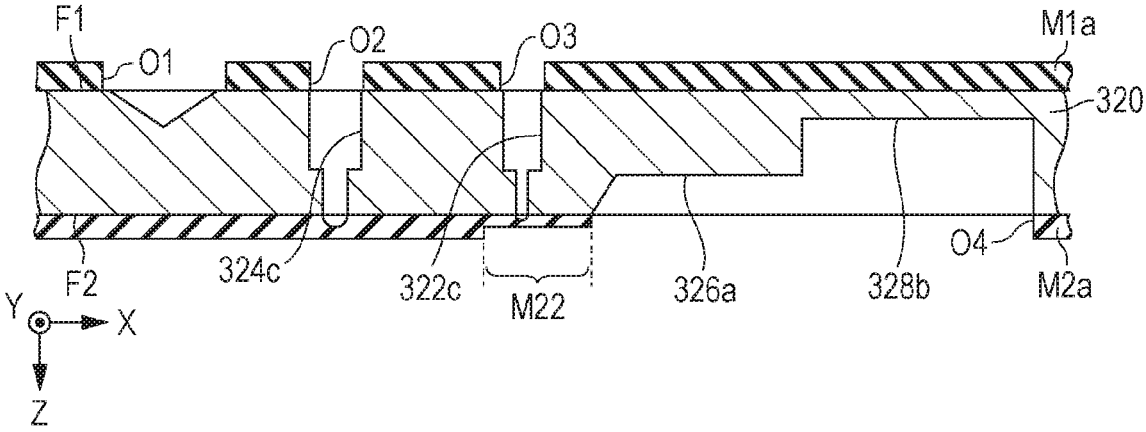
FIG. 13 is a diagram for explaining the second anisotropic etching in the etching process.

FIG. 13 is a diagram for explaining the second anisotropic etching in the etching process S20. As illustrated in FIG. 13, the substrate 320 is subjected to anisotropic etching using the masks M1*a* and M2*a*. Holes 322*c* and 324*c* and recessed portions 326*a* and 328*b* are formed by the anisotropic etching. The hole 322*c* is a hole formed by the hole 322*b* being widened by the anisotropic etching and is a hole including a portion of the supply flow path 322 in the depth direction. The hole 324*c* is a hole formed by the hole 324*b* being widened by the anisotropic etching and is a hole including a portion of the communicating flow path 324 in the depth direction. The recessed portion 326*a* is a portion of the supply liquid chamber 326. The recessed portion 328*b* is a recessed portion formed by the recessed portion 328*a* being widened by the anisotropic etching and is a portion of the opening portion 328. For example, a potassium hydroxide aqueous solution (KOH) or the like is used as the etchant of the anisotropic etching in the same manner as in the first anisotropic etching.

Figure 14:
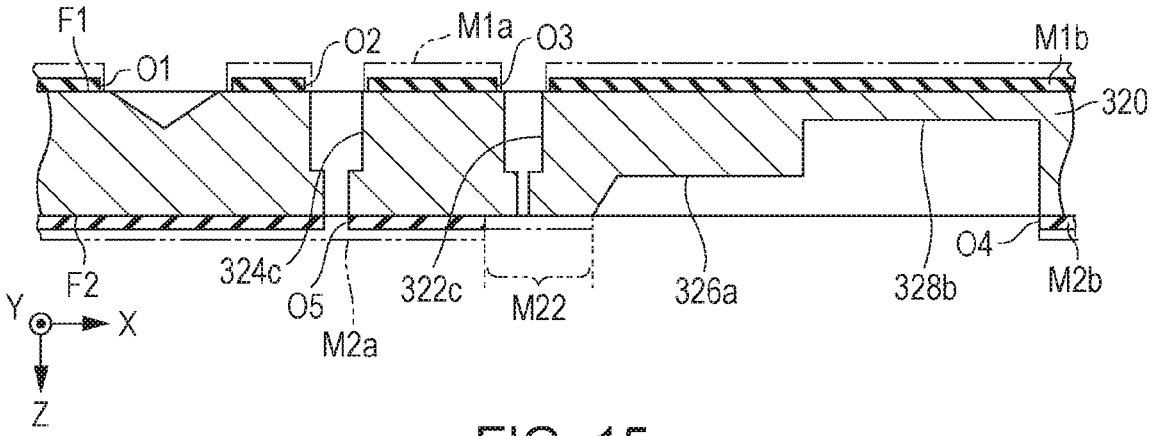
FIG. 14 is a sectional diagram for explaining masks to be used in a third anisotropic etching in the etching process.

FIG. 14 is a sectional diagram for explaining masks M1*b* and M2*b* to be used in the third anisotropic etching in the etching process S20. As illustrated in FIG. 14, the masks M1*b* and M2*b* are obtained by half-etching the masks M1*a* and M2*a* in the thickness directions. The mask M2*b* is a mask obtained by removing the portion M22 from the mask M2*a*. An opening portion O5 which communicates with the hole 324*b* is formed in the mask M2*b* illustrated in FIG. 14. For example, hydrofluoric acid (HF) or the like is used as the etchant of the half etching in the same manner as in the formation of the masks M1*a* and M2*a*.

Figure 15:
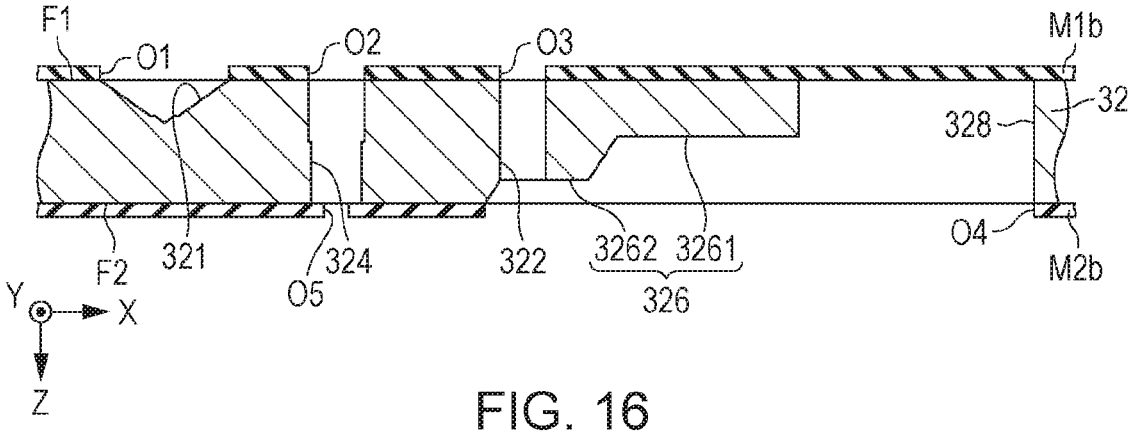
FIG. 15 is a diagram for explaining the third anisotropic etching in the etching process.

FIG. 15 is a diagram for explaining the third anisotropic etching in the etching process S20. As illustrated in FIG. 15, the substrate 320 is subjected to anisotropic etching using the masks M1*b* and M2*b*. The supply flow path 322, the communicating flow path 324, the supply liquid chamber 326, and the opening portion 328 are formed by the anisotropic etching. For example, a potassium hydroxide aqueous solution (KOH) or the like is used as the etchant of the anisotropic etching in the same manner as in the first or the second anisotropic etching.

Figure 16:
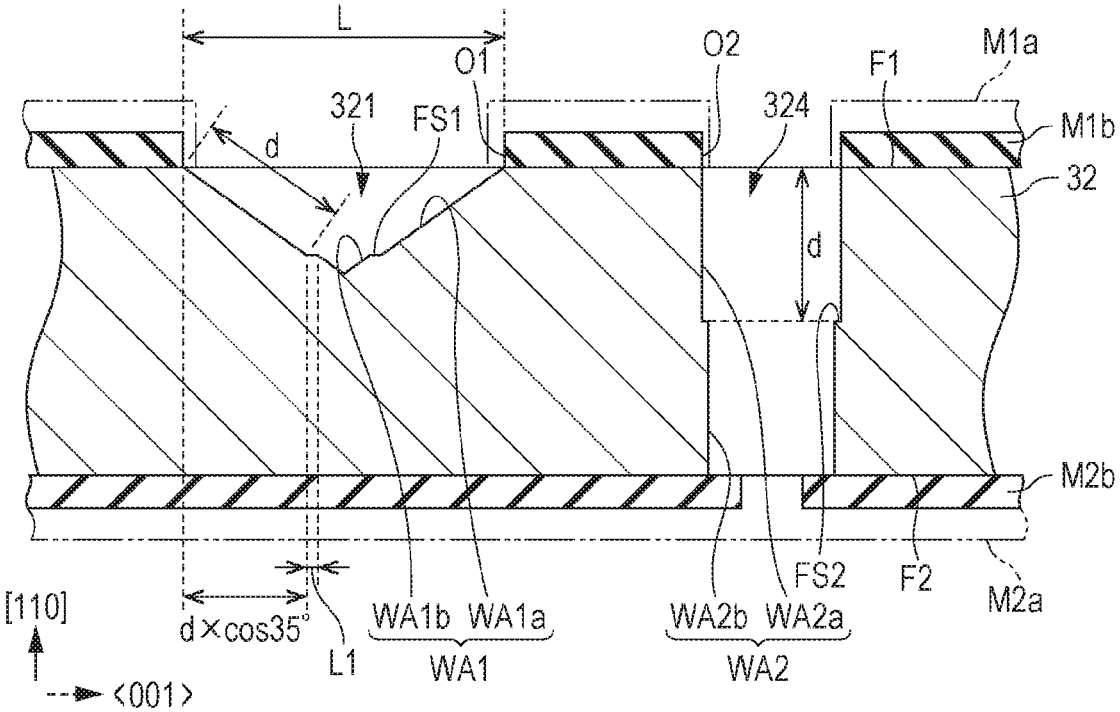
FIG. 16 is a sectional diagram for explaining level difference surfaces in the middle of the anisotropic etching.

FIG. 16 is a sectional diagram for explaining level difference surfaces FS1 and FS2 in the middle of the anisotropic etching. As illustrated in FIG. 16, the level difference surface FS1 is formed in the recessed portion 321 and the level difference surface FS2 is formed in the communicating flow path 324 in the third anisotropic etching. The opening portion O1 of the mask M1*a* is widened by the half etching illustrated in FIG. 14 to form the opening portion O1 of the mask M1*b*. Therefore, the first surface F1 that is newly exposed from the opening portion O1 is exposed to the etchant and is etched in the thickness directions during the third anisotropic etching. As a result, the level difference surface FS1 is formed. Similarly, the opening portion O2 of the mask M1*a* is widened by the half etching illustrated in FIG. 14 to form the opening portion O2 of the mask M1*b*. Therefore, the first surface F1 that is newly exposed from the opening portion O2 is exposed to the etchant and is etched in the thickness directions during the third anisotropic etching. As a result, the level difference surface FS2 is formed.

The positions of the level difference surfaces FS1 and FS2 both move from the first surface F1 side toward the second surface side F2 in accordance with the progression of the anisotropic etching. Since the level difference surface FS2 is provided in the middle of the wall surface WA2 which is perpendicular to the first surface F1, it is difficult to visually recognize the position of the level difference surface FS2. In contrast, since the level difference surface FS1 is provided in the middle of the wall surface WA1 which is comparatively mildly inclined with respect to the first surface F1, it is possible to visually recognize the position of the level difference surface FS1. Since the position of the level difference surface FS2 is a position corresponding to the level difference surface FS1, it is possible to estimate the position of the level difference surface FS2 based on the position of the level difference surface FS1.

Figure 17:
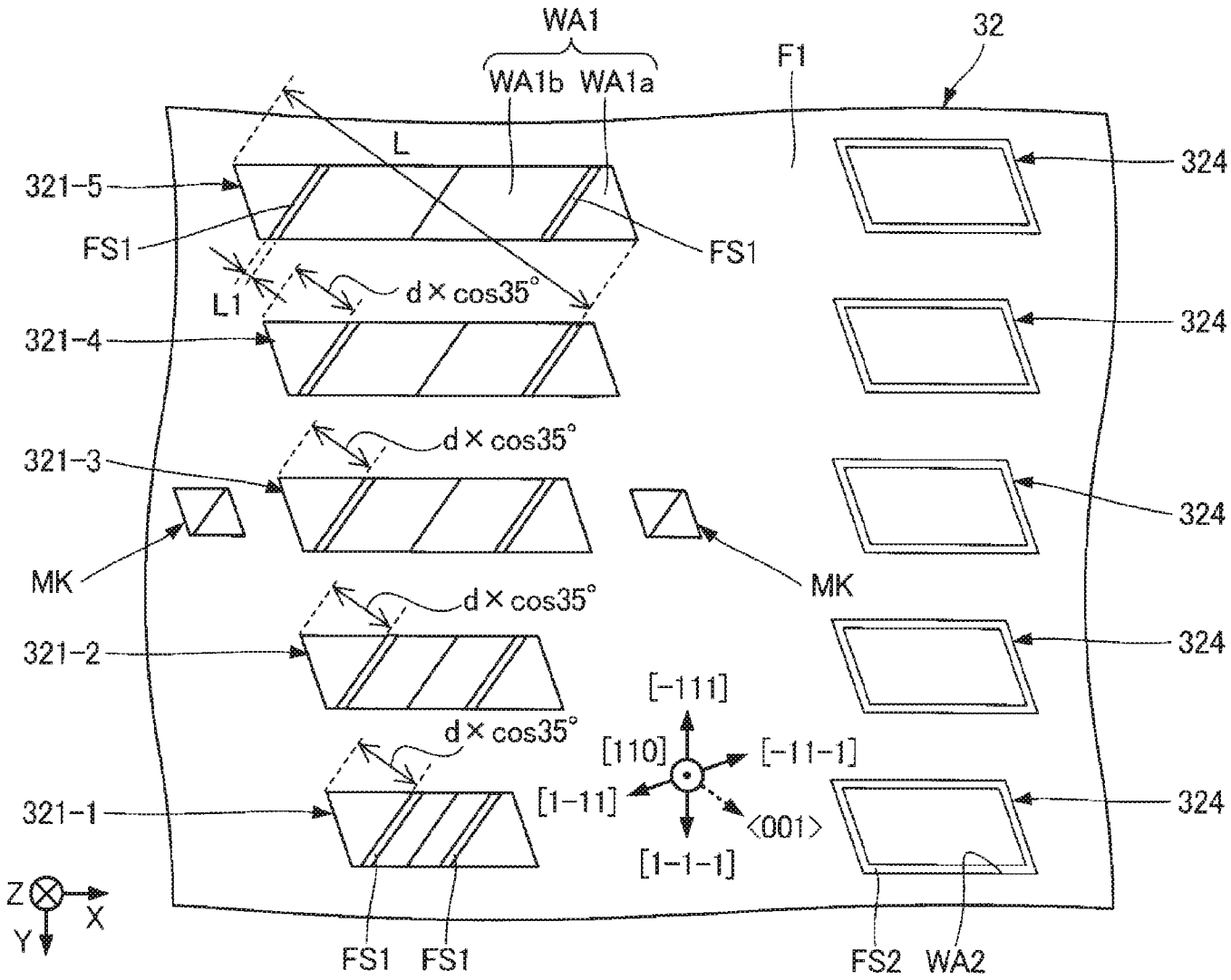
FIG. 17 is a plan view for explaining level difference surfaces formed in the plurality of first recessed portions in the etching process.

FIG. 17 is a plan view for explaining the level difference surfaces FS1 formed in the plurality of recessed portions 321-1 to 321-5 in the etching process S20. As illustrated in FIG. 17, when the first surface F1 is viewed in plan view during the third anisotropic etching, the level difference surfaces FS1 are observed in each of the recessed portions 321-1 to 321-5. As described earlier, since the level difference surfaces FS1 move from the first surface F1 side toward the second surface side F2 in accordance with the progression of the anisotropic etching, the level difference surfaces FS1 are lost in the plurality of recessed portions 321-1 to 321-5 in order from those having the smallest length L. In the example illustrated in FIG. 17, the marks MK indicating the recessed portion 321-3 among the recessed portions 321-1 to 321-5 are formed on the first surface F1. For example, the marks MK indicate that the desired distance d is achieved at the time point at which the level difference surfaces FS1 of the recessed portion 321-3 are lost. The positions, shapes, and the like of the marks MK are not limited to the example illustrated in FIG. 17. The marks MK may be formed by a method other than etching, such as by laser, for example. However, by forming the marks MK in the anisotropic etching together with the recessed portions 321, it is not necessary to provide a separate process for the marks MK and there is even a merit in that it is possible to form the marks MK at a similar dimensional precision to the dimensional precision of the recessed portions 321.

Here, since the angle formed by the wall surface WA1 and the first surface F1 is approximately 35°, at the time point at which the level difference surfaces FS1 are lost, the length L of the recessed portion 321 from which the level difference surfaces FS1 are lost and the distance between the first surface F1 and the level difference surface FS1 in a direction along the wall surface WA1 satisfies the relationship d×cos (35°=L/2. Therefore, the etching amount in the communicating flow path 324 is determined based on the length L of the recessed portion 321 at the time point at which the level difference surfaces FS1 are lost. In the present embodiment, the anisotropic etching is stopped based on the time point at which the level difference surfaces FS1 in the recessed portion 321-3 indicated by the marks MK are lost.

1-4c. Bonding Process S30

Although not illustrated, in the bonding process S30, the flow path substrate 32 and the pressure chamber substrate 34 are bonded to each other by the adhesive B. Subsequently, the liquid ejecting head 26 is obtained by assembling a bonded body obtained by bonding the flow path substrate 32 and the pressure chamber substrate 34 to each other and the other components which configure the liquid ejecting head 26.

The manufacturing method of the liquid ejecting head 26 includes the preparation process S10 and the etching process S20 as described earlier. In the preparation process S10, a substrate 420 which is a member configured by single crystal silicon and is the first member including the first surface F1 configured by the {110} plane in the single crystal silicon and the second surface F2 of the opposite side from the first surface F1. In the etching process S20, the communicating flow paths 324 which are through-holes spanning from the first surface F1 to the second surface F2, the recessed portions 321 which are the first recessed portions opened in the first surface F1, and the supply liquid chambers 326 which are the second recessed portions opened in the second surface F2 are formed in the substrate 420 using anisotropic etching. The recessed portion 321 includes the wall surface WA1 configured by the {111} plane, the wall surface being inclined with respect to the first surface F1 in the single crystal silicon. In the anisotropic etching, the level difference surface FS1 formed as a surface in a direction along the first surface F1 is formed in the middle of the wall surface WA1 in the depth direction of the recessed portion 321. The time point to stop the anisotropic etching is determined based on the state of the level difference surface FS1.

In the anisotropic etching in the etching process S20, the etching amount in the communicating flow path 324 is determined based on the length L of the recessed portion 321 along the <001> direction in the single crystal silicon in plan view at the time point at which the level difference surface FS1 is lost. It is possible to form the communicating flow path 324 of an etching amount corresponding to the length L of the recessed portion 321 in which the level difference surface FS1 is lost using the determination.

There is a plurality of the recessed portions 321 and the lengths L of the plurality of recessed portions 321 along the <001> direction in the single crystal silicon are different from each other in plan view. Therefore, it is possible to determine the etching amount in a stepwise manner.

The substrate 420 includes one or more marks MK provided on the first surface F1. The one or more marks MK indicate one of the plurality of recessed portions 321. Therefore, it is possible to specify the recessed portion 321 that serves as the standard of the determination of the etching amount by visually recognizing the marks MK. In the etching process S20, the anisotropic etching is stopped based on the time point at which the level difference surfaces FS1 in the recessed portion 321 indicated by the one or more marks MK are lost. As a result, the determination of the etching amount is easy as compared to a case in which the marks MK are not used.

2. Second Embodiment

A description will be given of the second embodiment of the present disclosure. Regarding elements having the same function as those of the first embodiment in each of the examples described hereinafter, the reference numerals used in the description of the first embodiment will be reused and the detailed description thereof will be omitted as appropriate.

Figure 18:
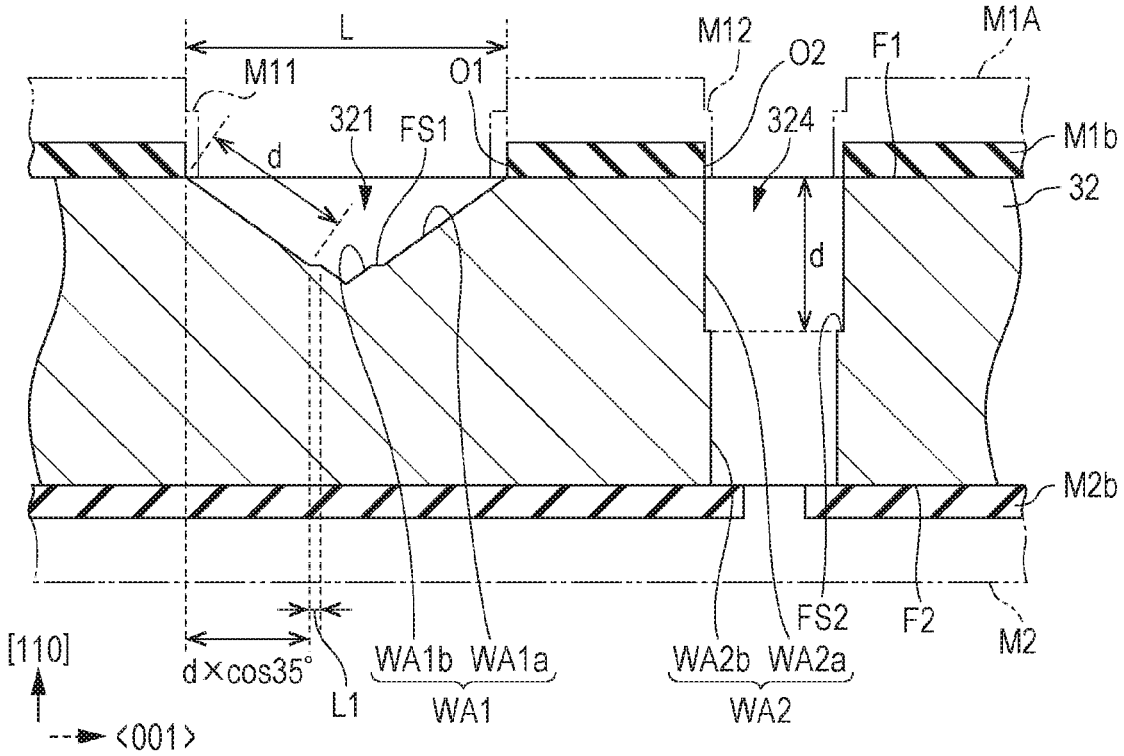
FIG. 18 is a sectional diagram for explaining the shape of a mask to be used in the manufacturing of a droplet discharging head according to a second embodiment.

FIG. 18 is a sectional diagram for explaining the shape of a mask M1A to be used in the manufacturing of a droplet discharging head according to the second embodiment. In the mask M1A indicated by the double dot dashed line in FIG. 18, the thickness of portions M11 and M12 corresponding to the level difference surfaces FS1 and FS2 is thin as compared to the other portions. Therefore, it is possible to remove the portions M11 and M12 using the second half-etching of the first embodiment. It is easy to manage the dimensions of the opening portions O1 and O2 of the mask M1*a* during the third anisotropic etching with the mask M1A as compared to in the first embodiment. As a result, there is a merit in that it is also easy to manage the dimensions of the level difference surfaces FS1 and FS2.

3. Third Embodiment

A description will be given of the third embodiment of the present disclosure. Regarding elements having the same function as those of the first embodiment in each of the examples described hereinafter, the reference numerals used in the description of the first embodiment will be reused and the detailed description thereof will be omitted as appropriate.

Figure 19:
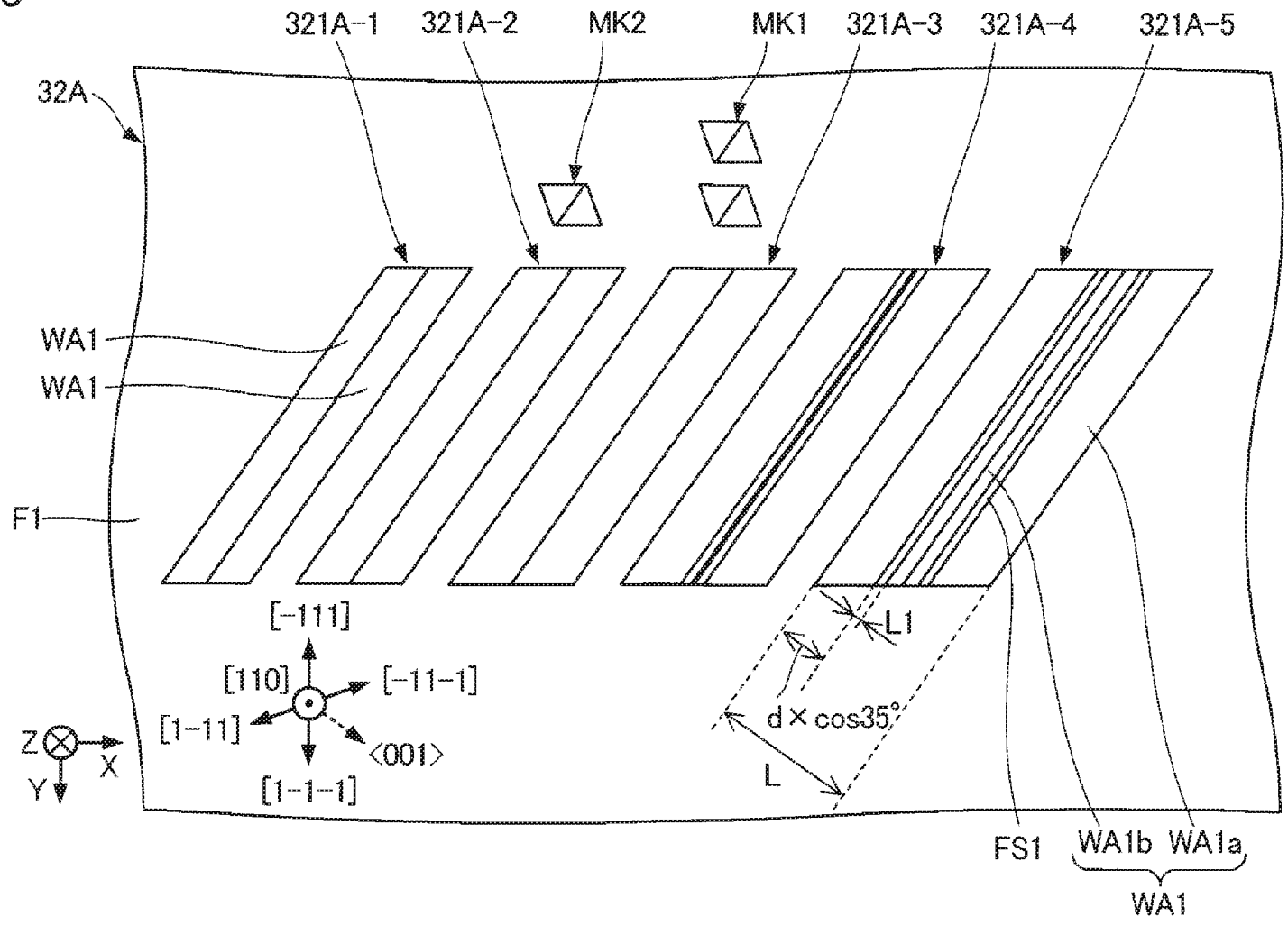
FIG. 19 is a plan view for explaining first recessed portions to be used in a droplet discharging head according to a third embodiment.

FIG. 19 is a plan view for explaining a plurality of recessed portions 321A-1 to 321A-5 to be used in a droplet discharging head according to the third embodiment. Each of the plurality of recessed portions 321A-1 to 321A-5 is an example of the first recessed portion. The plurality of recessed portions 321A-1 to 321A-5 is similar to the plurality of recessed portions 321-1 to 321-5 of the first embodiment other than in that the shape in plan view is different. The outer edge of each of the recessed portions 321A-1 to 321A-5 includes a pair of sides which orthogonally intersect the [−111] direction or the [1−1−1] direction and a pair of sides which orthogonally intersect the <001> direction. Even according to the third embodiment, a similar effect to that of the first embodiment is achieved. In FIG. 19, although the plurality of recessed portions 321A-1 to 321A-5 is lined up in the X directions, the disposition of the plurality of recessed portions 321A-1 to 321A-5 is not limited to the disposition illustrated in FIG. 19 and is arbitrary.

A first mark MK1 and a second mark MK2 are provided on the first surface F1. The first mark MK1 is disposed to indicate the one recessed portion 321A-3 of the recessed portions 321A-1 to 321A-5. The second mark MK2 has a different shape from the first mark MK1 and is disposed to indicate the one recessed portion 321A-2 of the recessed portions 321A-1 to 321A-5. It is possible to indicate the standard of the determination of the etching amount in a stepwise manner using the first mark MK1 and the second mark MK2. As a result, the determination of the etching amount is easy as compared to a case in which there is only one of the marks MK in number or type.

4. Fourth Embodiment

A description will be given of the fourth embodiment of the present disclosure. Regarding elements having the same function as those of the first embodiment in each of the examples described hereinafter, the reference numerals used in the description of the first embodiment will be reused and the detailed description thereof will be omitted as appropriate.

Figure 20:
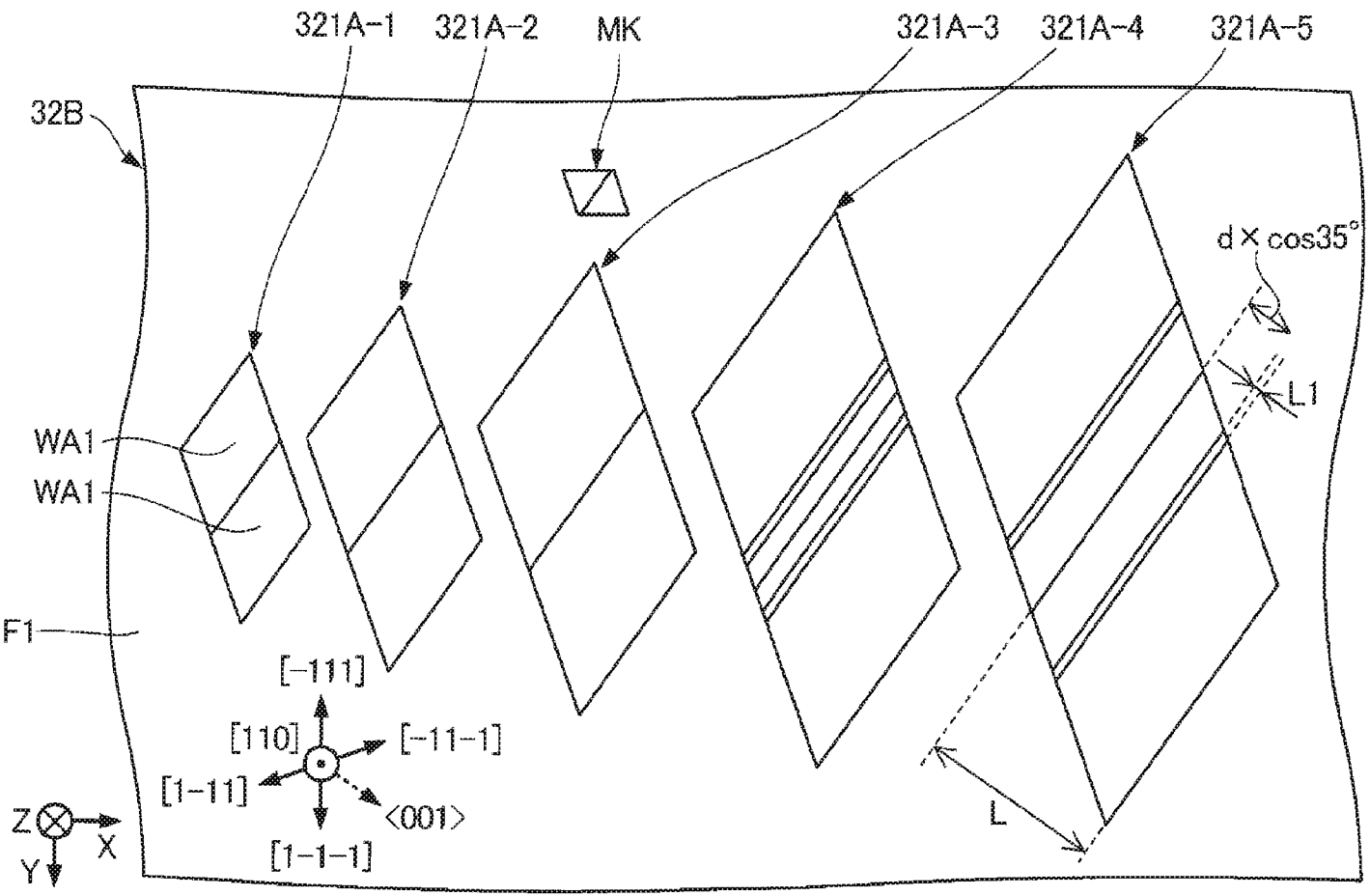
FIG. 20 is a plan view for explaining first recessed portions to be used in a droplet discharging head according to a fourth embodiment.

FIG. 20 is a plan view for explaining a plurality of recessed portions 321B-1 to 321B-5 to be used in a droplet discharging head according to the fourth embodiment. Each of the plurality of recessed portions 321B-1 to 321B-5 is an example of the first recessed portion. The plurality of recessed portions 321B-1 to 321B-5 is similar to the plurality of recessed portions 321-1 to 321-5 of the first embodiment other than in that the shape in plan view is different. The outer edge of each of the recessed portions 321B-1 to 321B-5 includes a pair of sides which orthogonally intersect the [−11−1] direction or the [1−11] direction and a pair of sides which orthogonally intersect the <001> direction. Even according to the fourth embodiment, a similar effect to that of the first embodiment is achieved. In FIG. 20, although the plurality of recessed portions 321B-1 to 321B-5 is lined up in the X directions, the disposition of the plurality of recessed portions 321B-1 to 321B-5 is not limited to the disposition illustrated in FIG. 20 and is arbitrary.

5. Modification Example

The embodiments exemplified above may be modified in various manners. Specific modified modes which may be applied to the embodiments will be exemplified hereinafter. Two or more modes selected arbitrarily from the following examples may be combined, as appropriate, in a range that is not mutually contradictory.

(1) In the embodiments, although a case in which the first member is the flow path substrate is exemplified, the present disclosure is not limited thereto. The first member may be a member including through-holes which are opened in a surface configured by the {110} plane of the single crystal silicon, and may be another member which configures the liquid ejecting head, for example.

(2) In the embodiments, although a case is exemplified in which the electronic device is the liquid ejecting head, the present disclosure is not limited thereto. The electronic device may be a device which uses the first member including the through-holes which are opened in the surface configured by the {110} plane of the single crystal silicon. In addition to the liquid ejecting head, examples of the electronic device include an ultrasonic device such as an ultrasonic transmitter, an ultrasonic motor, a thermoelectric converter, a pressure-electric converter, a ferroelectric transistor, a piezoelectric transformer, a blocking filter of harmful light such as infrared rays, an optical filter using the photonic crystal effect of quantum dot formation, and an optical filter which uses thin film optical interference, an infrared sensor, an ultrasonic sensor, a thermal sensor, a pressure sensor, a pyroelectric sensor, and a gyroscope.

(3) The drive element which causes the liquid (for example, the ink) inside the pressure chamber C to be ejected from the nozzle N is not limited to the piezoelectric element 44 exemplified in the embodiments. For example, it is also possible to use a heater element which generates bubbles in the inner portion of the pressure chamber C to cause the pressure to fluctuate as the drive element. As can be understood from the examples, the drive element is expressed comprehensively as an element (typically an element which applies a pressure to the inner portion of the pressure chamber C) which causes the liquid inside the pressure chamber C to be ejected from the nozzle N, and which type of drive system (piezoelectric system/thermal system) or specific configuration is to be adopted is not an issue.

(4) In the embodiments, although the liquid ejecting apparatus 100 of a serial system which causes the transporting body 242 on which the liquid ejecting head 26 is installed to reciprocate is exemplified, it is also possible to apply the present disclosure to a liquid ejecting apparatus of a line system in which the plurality of nozzles N is distributed over the full width of the medium 12.

(5) In addition to devices dedicated to printing, various devices such as facsimile devices and copiers may be adopted as the liquid ejecting apparatus 100 exemplified in the embodiments. Naturally, the use of the liquid ejecting apparatus of the present disclosure is not limited to printing. For example, a liquid ejecting apparatus which ejects a color material solution is used as a manufacturing apparatus which forms color filters of a display device such as a liquid crystal panel. A liquid ejecting apparatus which ejects a conductive material solution is used as a manufacturing apparatus which forms wiring and electrodes of a wiring substrate. A liquid ejecting apparatus which ejects an organic solution relating to a living body is used as a manufacturing apparatus which manufactures bio-chips, for example.

What is claimed is:

1. An electronic device comprising:

a first member configured by single crystal silicon, wherein the first member includes a first surface configured by a {110} plane in the single crystal silicon, a second surface of an opposite side from the first surface, a through-hole which spans from the first surface to the second surface, a first recessed portion which is opened on the first surface and includes a wall surface configured by a {111} plane, the wall surface being inclined by an angle greater than 0° and less than 90° with respect to the first surface in the single crystal silicon, and a second recessed portion opened in the second surface, and a level difference surface having a different inclination to that of the {111} plane is provided in the middle of the wall surface of the first recessed portion in a depth direction.

2. The electronic device according to claim 1, wherein a plurality of the level difference surfaces which extend in one direction parallel to each other is provided in the first recessed portion.

3. The electronic device according to claim 1, wherein the through-hole includes a wall surface configured by the {111} plane, the wall surface being perpendicular to the first surface in the single crystal silicon.

4. The electronic device according to claim 1, wherein regarding a length of the through-hole along a direction perpendicular to a penetration direction of the through-hole, the length of the through-hole in the first surface is greater than the length of the through-hole in the second surface.

5. The electronic device according to claim 1, further comprising:

a second member bonded to the first surface by an adhesive.

6. The electronic device according to claim 5, wherein a thickness of the adhesive is greater than a distance between the first surface and the level difference surface along a depth direction of the first recessed portion.

7. The electronic device according to claim 1, wherein there is a plurality of the first recessed portions.

8. The electronic device according to claim 7, wherein the lengths of the plurality of first recessed portions along a <001> direction in the single crystal silicon are different from each other in plan view.

9. The electronic device according to claim 8, wherein the plurality of first recessed portions is disposed to line up in order of length of the first recessed portions along the <001> direction in the single crystal silicon in plan view.

10. The electronic device according to claim 8, wherein the first member includes one or more marks provided on the first surface indicating one of the first recessed portions of the plurality of first recessed portions.

11. The electronic device according to claim 10, wherein the one or more marks include a first mark and a second mark which is different from the first mark.

12. The electronic device according to claim 1, wherein a ratio of a length of the level difference surface along a <001> direction in the single crystal silicon in plan view with respect to a length of the first recessed portion along the <001> direction in the single crystal silicon in plan view is less than or equal to 1/10.

13. An electronic device comprising:

a first member configured by single crystal silicon, wherein the first member includes a first surface configured by a {110} plane in the single crystal silicon, a second surface of an opposite side from the first surface, a through-hole which spans from the first surface to the second surface, a first recessed portion which is opened on the first surface and includes a wall surface configured by a {111} plane, the wall surface being inclined by an angle greater than 0° and less than 90° with respect to the first surface in the single crystal silicon, wherein a plurality of the level difference surfaces which extend in one direction parallel to each other is provided in the first recessed portion, and a second recessed portion opened in the second surface, and a level difference surface having a different inclination to that of the {111} plane is provided in the middle of the wall surface of the first recessed portion in a depth direction.

14. An electronic device comprising:

a first member configured by single crystal silicon, wherein the first member includes a first surface configured by a {110} plane in the single crystal silicon, a second surface of an opposite side from the first surface, a through-hole which spans from the first surface to the second surface, wherein the through-hole includes a wall surface configured by the {111} plane, the wall surface being perpendicular to the first surface in the single crystal silicon, a first recessed portion which is opened on the first surface and includes a wall surface configured by a {111} plane, the wall surface being inclined by an angle greater than 0° and less than 90° with respect to the first surface in the single crystal silicon, and a second recessed portion opened in the second surface, and a level difference surface having a different inclination to that of the {111} plane is provided in the middle of the wall surface of the first recessed portion in a depth direction.

* * * * *